US007850509B2

(12) United States Patent
Togawa et al.

(10) Patent No.: US 7,850,509 B2
(45) **Date of Patent: *Dec. 14, 2010**

(54) SUBSTRATE HOLDING APPARATUS

(75) Inventors: Tetsuji Togawa, Chigasaki (JP); Ikutaro Noji, Yokohama (JP); Keisuke Namiki, Fujisawa (JP); Hozumi Yasuda, Fujisawa (JP); Shunichiro Kojima, Yokohama (JP); Kunihiko Sakurai, Yokohama (JP); Nobuyuki Takada, Fujisawa (JP); Osamu Nabeya, Chigasaki (JP); Makoto Fukushima, Yokohama (JP); Hideki Takayanagi, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/285,936

(22) Filed: Oct. 16, 2008

(65) Prior Publication Data

US 2009/0061748 A1 Mar. 5, 2009

Related U.S. Application Data

(60) Continuation of application No. 11/452,218, filed on Jun. 14, 2006, now Pat. No. 7,491,117, which is a division of application No. 11/028,629, filed on Jan. 5, 2005, now Pat. No. 7,083,507, which is a division of application No. 09/973,842, filed on Oct. 11, 2001, now Pat. No. 6,852,019.

(30) Foreign Application Priority Data

Oct. 11, 2000 (JP) ..... 2000-311071
Jan. 22, 2001 (JP) ..... 2001-013899

(51) Int. Cl.
*B24B 7/22* (2006.01)

(52) U.S. Cl. ..... 451/288; 451/388

(58) Field of Classification Search ..... 451/288, 451/287, 398, 388, 41, 289, 290
See application file for complete search history.

(56) References Cited

U.S. PATENT DOCUMENTS 5,559,428 A 9/1996 Li et al.

(Continued)

FOREIGN PATENT DOCUMENTS

EP 0650806 A1 10/1994

(Continued)

OTHER PUBLICATIONS

European Search Report issued Jun. 5, 2008 in European Application No. 02 78 8744.

(Continued)

*Primary Examiner*—Robert Rose
(74) *Attorney, Agent, or Firm*—Wenderoth, Lind & Ponack, L.L.P.

(57) ABSTRACT

The present invention relates to a substrate holding apparatus for holding and pressing a substrate against a polishing surface. The substrate holding apparatus includes a top ring body for holding the substrate, an elastic pad for contacting the substrate, and a support member for supporting the elastic pad. The substrate holding apparatus further includes a contact member mounted on a lower surface of the support member and disposed in a space formed by the elastic pad and the support member. The contact member has an elastic membrane for contacting the elastic pad. A first pressure chamber is defined in the contact member, and a second pressure chamber is defined outside of the contact member. The substrate holding apparatus also includes a fluid source for independently supplying a fluid into, or creating a vacuum in, the first pressure chamber and the second pressure chamber.

5 Claims, 11 Drawing Sheets

U.S. PATENT DOCUMENTS

| | | | | |
|---|---|---|---|---|
| 5,584,751 | A | 12/1996 | Kobayashi et al. | |
| 5,605,488 | A | 2/1997 | Ohashi et al. | |
| 5,643,053 | A | 7/1997 | Shendon | |
| 5,733,182 | A | 3/1998 | Muramatsu et al. | |
| 5,820,448 | A | 10/1998 | Shamouilian et al. | |
| 5,882,245 | A | 3/1999 | Popovich et al. | |
| 5,938,884 | A | 8/1999 | Hoshizaki et al. | |
| 5,941,758 | A | 8/1999 | Mack | |
| 5,964,653 | A | 10/1999 | Perlov et al. | |
| 6,056,632 | A | 5/2000 | Mitchel et al. | |
| 6,077,151 | A | 6/2000 | Black et al. | |
| 6,080,050 | A | 6/2000 | Chen et al. | |
| 6,083,090 | A | 7/2000 | Bamba | |
| 6,093,089 | A | 7/2000 | Chen et al. | |
| 6,106,378 | A | 8/2000 | Perlov et al. | |
| 6,146,259 | A | 11/2000 | Zuniga et al. | |
| 6,159,079 | A | 12/2000 | Zuniga et al. | |
| 6,165,058 | A | 12/2000 | Zuniga et al. | |
| 6,183,354 | B1 | 2/2001 | Zuniga et al. | |
| 6,203,414 | B1 | 3/2001 | Numoto et al. | |
| 6,210,255 | B1 | 4/2001 | Zuniga et al. | |
| 6,386,955 | B2 | 5/2002 | Zuniga et al. | |
| 6,406,361 | B1 | 6/2002 | Zuniga et al. | |
| 6,422,927 | B1 | 7/2002 | Zuniga | |
| 6,450,868 | B1 | 9/2002 | Zuniga et al. | |
| 6,514,124 | B1 | 2/2003 | Zuniga et al. | |
| 6,527,624 | B1 | 3/2003 | Tolles et al. | |
| 6,776,692 | B1 | 8/2004 | Zuniga et al. | |
| 6,776,694 | B2 * | 8/2004 | Zuniga et al. | 451/41 |
| 7,491,117 | B2 * | 2/2009 | Togawa et al. | 451/288 |
| 2005/0020185 | A1 | 1/2005 | Zuniga et al. | |
| 2005/0142993 | A1 | 6/2005 | Chen et al. | |

FOREIGN PATENT DOCUMENTS

| | | |
|---|---|---|
| EP | 0768148A 1 | 4/1997 |
| EP | 0922531 AI | 9/1998 |
| EP | 1 066 925 | 1/2001 |
| JP | 07-122523 | 5/1995 |
| JP | 08-285514 | 11/1996 |
| JP | 10-202520 | 8/1998 |
| JP | 11-19868 | 1/1999 |
| JP | 11-019868 | 1/1999 |
| JP | 11-129154 | 5/1999 |
| JP | 11-176775 | 7/1999 |
| JP | 11-226865 | 8/1999 |
| JP | 11-262857 | 9/1999 |
| JP | 2000-225559 | 8/2000 |
| JP | 2000-263421 | 9/2000 |
| WO | 99/02304 | 1/1999 |
| WO | 00/13851 | 3/2000 |
| WO | 00/21715 | 4/2000 |
| WO | 00/51782 | 9/2000 |

OTHER PUBLICATIONS

European Search Report issued Jun. 20, 2008 in European Application No. 08 00 7317.

European Search Report issued Jun. 20, 2008 in European Application No. 08 00 7303.

European Search Report issued Aug. 24, 2007 in European Application No. 07 01 4804.

U.S. Office Action, issued in U.S. Appl. No. 11/452,218, mailed Dec. 27, 2006.

U.S. Office Action, issued in U.S. Appl. No. 11/452,218, mailed Jan. 7, 2008.

U.S. Office Action, issued in U.S. Appl. No. 11/452,218 mailed Aug. 6, 2008.

U.S. Office Action, issued in U.S. Appl. No. 11/452,218, mailed Jun. 13, 2007.

U.S. Advisory Action, issued in U.S. Appl. No. 11/452,218, mailed Oct. 3, 2007.

U.S. Advisory Action, issued in U.S. Appl. No. 11/452,218, mailed Oct. 17, 2007.

European Office Action issued Nov. 5, 2008 in connection with EP 08 007 303 corresponding to the present U.S. application.

European Office Action issued Nov. 14, 2008 in connection with EP 08 007 317 corresponding to the present U.S. application.

European Office Action issued Nov. 28, 2008 in connection with EP 07 014 804 corresponding to the present U.S. application.

Korean Office Action issued Oct. 9, 2008 in connection with Korean Patent Application No. 10-2008-6629 corresponding to the present U.S. application.

Korean Office Action issued May 7, 2009 in connection with Korean Patent Application No. 10-2008-6629 corresponding to the present U.S. application.

Japanese Office Action issued Sep. 29, 2009 in Japanese Application No. 2007-071591 (and its English translation).

Japanese Office Action issued Jan. 29, 2008 in Japanese Application No. 2001-013899 (and its English translation).

Japanese Office Action issued Aug. 5, 2008 in Japanese Application No. 2001-013899 (and its English translation).

Japanese Examiner's Final Decision of Refusal issued Sep. 1, 2009 in Japanese Application No. 2001-013899 (and its English translation).

* cited by examiner

SUBSTRATE HOLDING APPARATUS

This application is a continuation of U.S. application Ser. No. 11/452,218, filed Jun. 14, 2006 now U.S. Pat. No. 7,491,117, which is a divisional of U.S. application Ser. No. 11/028,629, filed Jan. 5, 2005, now U.S. Pat. No. 7,083,507, which is a divisional of U.S. application Ser. No. 09/973,842, filed Oct. 11, 2001, now U.S. Pat. No. 6,852,019.

BACKGROUND OF THE INVENTION

1. Field of the Invention

The present invention relates to a substrate holding apparatus for holding a pressing a substrate against a polishing surface, and more particularly to a substrate holding apparatus for holding a substrate such as a semiconductor wafer in a polishing apparatus for polishing the substrate.

2. Description of the Related Art

In a manufacturing process of a semiconductor device, a thin film is formed on a semiconductor device, and then micro-machining processes, such as patterning or forming holes, are performed. Thereafter, the above processes are repeated to form thin films on the semiconductor device. Recently, semiconductor devices have become more integrated, and structure of semiconductor elements have become more complicated. In addition, the number of layers in multilayer interconnections used for a logical system has been increased. Therefore, irregularities on a surface of the semiconductor device are increased, so that a step height on the surface of the semiconductor device becomes larger.

When irregularities of a surface of a semiconductor device are increased, the following problems arise. First, the thickness of a film formed in a portion having a step is relatively small. Also, an open circuit is caused by disconnection of interconnections, or a short circuit is caused by insufficient insulation between layers. As a result, good products cannot be obtained, and a yield is reduced. Further, even if a semiconductor device initially works normally, reliability of the semiconductor device is lowered after a long-term use. At a time of exposure during a lithography process, if an irradiation surface has irregularities, then a lens unit in an exposure system is locally unfocused. Therefore, if the irregularities of the surface of the semiconductor device are increased, it is difficult to form a fine pattern on the semiconductor device.

Thus, during a manufacturing process of a semiconductor device, it is increasingly important to planarize a surface of the semiconductor device. The most important planarizing technology is chemical mechanical polishing (CMP). In chemical mechanical polishing using a polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus comprises a polishing table having a polishing surface constituted by a polishing pad, and a substrate holding apparatus, such as a top ring or a carrier head, for holding a semiconductor wafer. When a semiconductor wafer is polished with this type of polishing apparatus, the semiconductor wafer is held by the substrate holding apparatus and pressed against the polishing pad under a predetermined pressure. At this time, the polishing table and the substrate holding apparatus are moved relative to each other to bring the semiconductor wafer into sliding contact with the polishing surface, so that the surface of the semiconductor wafer is polished to a flat mirror finish.

If the pressing force produced between the semiconductor wafer and the polishing surface of the polishing pad is not uniform over the entire surface of the semiconductor wafer, the semiconductor wafer is insufficiently or excessively polished depending on the pressing force applied to the semiconductor wafer. Therefore, it has been attempted that a holding surface of the substrate holding apparatus is formed by an elastic membrane of an elastic material such as rubber, and a fluid pressure such as air pressure is applied to a backside surface of the elastic membrane to make uniform the pressing force applied to the semiconductor wafer uniform over the entire surface of the semiconductor wafer.

The polishing pad is so elastic that the pressing force applied to a peripheral portion of the semiconductor wafer becomes non-uniform and hence the peripheral portion of the semiconductor wafer is excessively polished to cause edge rounding. In order to prevent such edge rounding, there has been used a substrate holding apparatus in which a semiconductor wafer is held at its peripheral portion by a guide ring or a retainer ring, and an annular portion of a polishing surface that corresponds to the peripheral portion of the semiconductor wafer is pressed by the guide ring or the retainer ring.

The thickness of a thin film formed on a surface of a semiconductor wafer varies from position to position in a radial direction of the semiconductor wafer depending on a film deposition method or characteristics of a film deposition apparatus. Specifically, the thin film has a film thickness distribution in the radial direction of the semiconductor wafer. When a conventional substrate holding apparatus for uniformly pressing an entire surface of the semiconductor wafer is used for polishing the semiconductor wafer, the entire surface of the semiconductor wafer is polished uniformly. Therefore, a conventional substrate holding apparatus cannot realize a polishing amount distribution that is equal to the film thickness distribution on the surface of the semiconductor wafer, and hence cannot sufficiently cope with the film thickness distribution in the radial direction so as to cause insufficient or excessive polishing.

As described above, the film thickness distribution on the surface of the semiconductor wafer varies depending on the type of film deposition method or the type film deposition apparatus employed. Specifically, the position and number of portions having a large film thickness in the radial direction and the difference in thickness between the thin film portions and the thick film portions vary depending on the type of film deposition method or the type of film deposition apparatus employed. Therefore, a substrate holding apparatus capable of easily coping with various film thickness distributions at low cost has been required rather than a substrate holding apparatus capable of coping with only a specific film thickness distribution.

SUMMARY OF THE INVENTION

The present invention has been made in view of the above drawbacks. It is therefore an object of the present invention to provide a substrate holding apparatus capable of polishing a substrate such as a semiconductor wafer in accordance with a thickness distribution of thin film formed on a surface of the substrate, and obtaining a uniform film thickness after polishing.

It is another object of the present invention to provide a substrate holding apparatus capable of easily coping with not only a specific film thickness distribution but also various film thickness distributions at low cost.

According to an aspect of the present invention, there is provided a substrate holding apparatus for holding and pressing a substrate against a polishing surface. The substrate holding apparatus comprises: a top ring body for holding the substrate; an elastic pad for being brought into contact with the substrate; a support member for supporting the elastic pad; a contact member mounted on a lower surface of the support member and disposed in a space formed by the elastic pad and the support member, the contact member having an elastic membrane for being brought into contact with the elastic pad; a first pressure chamber defined in the contact member; a second pressure chamber defined outside of the contact member; and a fluid source for independently supplying a fluid into, or creating a vacuum in, the first pressure chamber and the second pressure chamber.

According to another aspect of the present invention, there is provided a substrate holding apparatus for holding and pressing a substrate against a polishing surface. The substrate holding apparatus comprises: a top ring body for holding a substrate; a seal ring for being brought into contact with an upper surface of a peripheral portion of the substrate; a support member for supporting the seal ring; a contact member mounted on a lower surface of the support member and disposed in a space formed by the substrate, the seal ring and the support member, with the contact member having an elastic membrane for being brought into contact with the substrate; a first pressure chamber defined in the contact member; a second pressure chamber defined outside of the contact member; and a fluid source for independently supplying a fluid into, or creating a vacuum in, the first pressure chamber and the second pressure chamber.

According to still another aspect of the present invention, there is provided a substrate holding apparatus for holding and pressing a substrate against a polishing surface. The substrate holding apparatus comprises: a top ring body for holding the substrate; a support member having a contact member mounted on a lower surface thereof, the contact member being disposed in a space formed by the substrate and the support member and having an elastic membrane for being brought into contact with the substrate; a first pressure chamber defined in the contact member; a second pressure chamber defined outside of the contact member; and a fluid source for independently supplying a fluid into, or creating a vacuum in, the first pressure chamber and the second pressure chamber.

According to another aspect of the present invention, there is provided a substrate holding apparatus for holding and pressing a substrate against a polishing surface. The substrate holding apparatus comprises: a top ring body for holding the substrate; an elastic pad for being brought into contact with the substrate; a support member for supporting the elastic pad; and contact members mounted on a lower surface of the support member, the contact members each having an elastic membrane for being brought into contact with the elastic pad and being independently pressed against the elastic pad.

According to the present invention, the pressures in a first pressure chamber and a second pressure chamber can be independently controlled. Therefore, a pressing force applied to a thicker area of a thin film on a substrate can be made higher than a pressing force applied to a thinner area of the thin film, thereby selectively increasing a polishing rate of the thicker area of the thin film. Consequently, the entire surface of the substrate can be polished exactly to a desired level irrespective of a film thickness distribution obtained at a time the thin film is formed. The pressing force is the pressure per unit area for pressing the substrate against a polishing surface.

In a preferred aspect of the present invention, the fluid source supplies a fluid, controlled in terms of temperature, into the first pressure chamber and the second pressure chamber, respectively. Preferably, the contact members are spaced from one another at predetermined intervals.

According to another aspect of the present invention, a communicating portion for allowing fluid supplied to the first pressure chamber to contact a contact surface of the substrate is formed in a lower surface of the elastic membrane of a contact member. When pressurized fluids supplied to the pressure chambers are controlled in terms of temperature and a temperature of the substrate is controlled from a backside of the surface to be polished, the above arrangement can increase an area in which a pressurized fluid, controlled in terms of temperature, is brought into contact with the substrate. Therefore, control of the temperature of the substrate can be improved. Further, when polishing of the substrate is finished and the substrate is released, the pressure chambers are respectively opened to outside air via the communicating portion. Thus, fluids supplied into the pressure chambers are prevented from remaining in the pressure chambers. Therefore, even when substrates are continuously polished, control of the temperature of the substrate can be maintained.

In a substrate holding apparatus comprising a seal ring, a lower surface of the support member is not covered after a substrate is released. Therefore, a large part of the lower surface of the support member is exposed after the substrate is released, so that the substrate holding apparatus can be easily cleaned after a polishing process. In either the substrate holding apparatus comprising an elastic pad or the substrate holding apparatus comprising a seal ring, the support member should preferably be made of an insulating material such as resin or ceramic. The seal ring should preferably extend radially inwardly from an innermost position of a recess, such as a notch or orientation flat, for recognizing or identifying an orientation of a substrate.

In a preferred aspect of the present invention, each contact member comprises a holding member for detachably holding its elastic membrane. With this arrangement, the elastic membrane of the contact member can be easily replaced and, hence, the position and size of the first pressure chamber and the second pressure chamber can be changed simply by changing the elastic membrane of the contact member. Therefore, a substrate holding apparatus according to the present invention can easily cope with various thickness distributions of a thin film formed on a substrate to be polished at a low cost.

In another preferred aspect of the present invention, the holding member of each contact member is detachably mounted on the support member. With this arrangement, the contact member can be easily replaced and, hence, the position and size of the first pressure chamber and the second pressure chamber can be changed simply by changing the contact member. Therefore, a substrate holding apparatus according to the present invention can easily cope with various thickness distributions of a thin film formed on the substrate at a low cost.

In still another preferred aspect of the present invention, protrusions are provided on a lower surface of the elastic membrane. The protrusions extend radially from a circumferential edge of the elastic membrane of each contact member. The protrusions are brought into close contact with an elastic pad or a substrate by a pressurized fluid supplied to the second pressure chamber to prevent the pressurized fluid from flowing into a lower portion of the contact member. Hence, a range of pressure control can be widened to press the substrate against a polishing surface more stably.

In another preferred aspect of the present invention, the contact member includes a central contact member disposed at a position corresponding to a central portion of the substrate to be processed, and an outer contact member disposed outside of the central contact member.

In still another preferred aspect of the present invention, the outer contact member is mounted at a position corresponding to an outer peripheral portion of the substrate to be processed. With this arrangement, the pressing force applied to the peripheral portion of the substrate is appropriately controlled to suppress effects due to elastic deformation of a polishing surface or entry of a polishing liquid into the space between the polishing surface and the substrate, to thereby uniformly polish the peripheral portion of the substrate.

In another preferred aspect of the present invention, the substrate holding apparatus further comprises a retainer ring fixed to, or integrally formed with, the top ring body for holding a peripheral portion of the substrate.

In still another preferred aspect of the present invention, the top ring body comprises a cleaning liquid passage defined therein for supplying a cleaning liquid into a gap defined between an outer circumferential surface of the elastic pad and the retainer ring. When a cleaning liquid (pure water) is supplied from the cleaning liquid passage into the gap defined between the outer circumferential surface of the elastic pad and the retainer ring, any polishing liquid in the gap is washed away. Therefore, the support member, the elastic pad, or the substrate can be smoothly moved in a vertical direction with respect to the top ring body and the retainer ring.

In another preferred aspect of the present invention, the retainer ring is fixed to the top ring body without interposing an elastic member between the retainer ring and the top ring body. If an elastic member such as rubber is clamped between the retainer ring and the top ring body, then a desired horizontal surface cannot be maintained on a lower surface of the retainer ring because of elastic deformation of this elastic member. However, the above arrangement, i.e. absent an elastic member between the retainer ring and the top ring body, can maintain a desired horizontal surface on the lower surface of the retainer ring.

In still another preferred aspect of the present invention, the elastic membrane of each contact member has a different thicknesses, or partially includes an inelastic member. With this arrangement, deformation of the elastic membrane due to pressure in the first and second pressure chambers can be optimized.

According to another aspect of the present invention, there is provided a polishing apparatus comprising the above-described substrate holding apparatus and a polishing table having a polishing surface.

According to still another aspect of the present invention, there is provided a substrate holding apparatus for holding and pressing the substrate against a polishing surface, comprising: a top ring body for holding the substrate; annular members formed of an elastic material for being held in contact with the substrate; sections defined by the annular members, the sections being opened downwardly; and a fluid passage for supplying a fluid into the sections.

According to another aspect of the present invention, there is provided a polishing method for polishing a substrate, comprising: pressing the substrate against a polishing surface provided on a polishing table; and polishing the substrate in such a state that the pressing force applied to a thicker area of a thin film on the substrate is made higher than the pressing force applied to a thinner area of the thin film.

According to still another aspect of the present invention, there is provided a polishing method for polishing a substrate, comprising: pressing the substrate against a polishing surface provided on a polishing table; defining sections opened downwardly by annular members formed of an elastic material held in contact with the substrate; and supplying a fluid into, or creating a vacuum in, the sections.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

A polishing apparatus according to a first embodiment of the present invention will be described below with reference to FIGS. 1 through 6.

Figure 1:
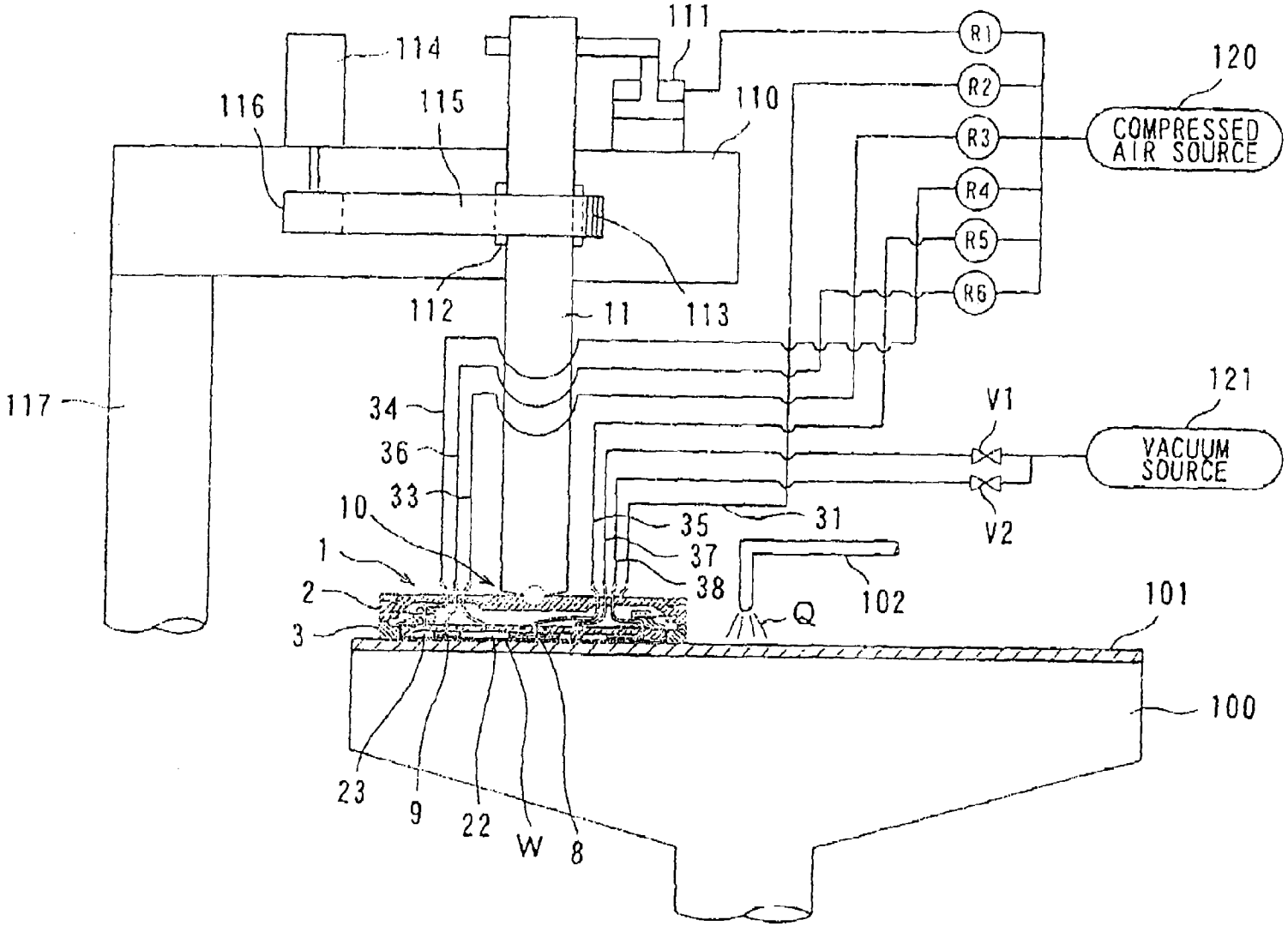
FIG. 1 is a cross-sectional view showing an entire structure of a polishing apparatus according to a first embodiment of the present invention.

FIG. 1 is a cross-sectional view showing the entire structure of a polishing apparatus having a substrate holding apparatus according to the first embodiment of the present invention. The substrate holding apparatus serves to hold a substrate, such as a semiconductor wafer, and to press the substrate against a polishing surface of a polishing table. As shown in FIG. 1, a polishing table 100 is disposed underneath a top ring 1 constituting the substrate holding apparatus according to the present invention, and has a polishing pad 101 attached to an upper surface thereof. A polishing liquid supply nozzle 102 is disposed above the polishing table 100 and supplies a polishing liquid Q onto the polishing pad 101 on the polishing table 100.

Various kinds of polishing pads are sold on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is rigid foam polyurethane (single-layer). Foam polyurethane is porous and has a large number of fine recesses or holes formed in its surface.

The top ring 1 is connected to a top ring drive shaft 11 by a universal joint 10. The top ring drive shaft 11 is coupled to a top ring air cylinder 111 fixed to a top ring head 110. The top ring air cylinder 111 operates to vertically move the top ring drive shaft 11 to thus lift and lower the top ring 1 as a whole. The top ring air cylinder 111 also operates to press a retainer ring 3, fixed to a lower end of a top ring body 2, against the polishing pad 101. The top ring air cylinder 111 is connected to a compressed air source (fluid source) 120 via a regulator R1, which regulates the pressure of air supplied to the top ring air cylinder 111 to thereby adjust the pressing force with which the retainer ring 3 presses the polishing pad 101.

The top ring drive shaft 11 is connected to a rotary sleeve 112 by a key (not shown). The rotary sleeve 112 has a timing pulley 113 fixedly disposed therearound. A top ring motor 114 having a drive shaft is fixed to an upper surface of the top ring head 110. The timing pulley 113 is operatively coupled to a timing pulley 116, mounted on a drive shaft of the top ring motor 114, by a timing belt 115. When the top ring motor 114 is energized, the timing pulley 116, the timing belt 115, and the timing pulley 113 are rotated to rotate the rotary sleeve 112 and the top ring drive shaft 11 in unison with each other, thus rotating the top ring 1. The top ring head 110 is supported on a top ring head shaft 117 fixedly supported on a frame (not shown).

Figure 2:
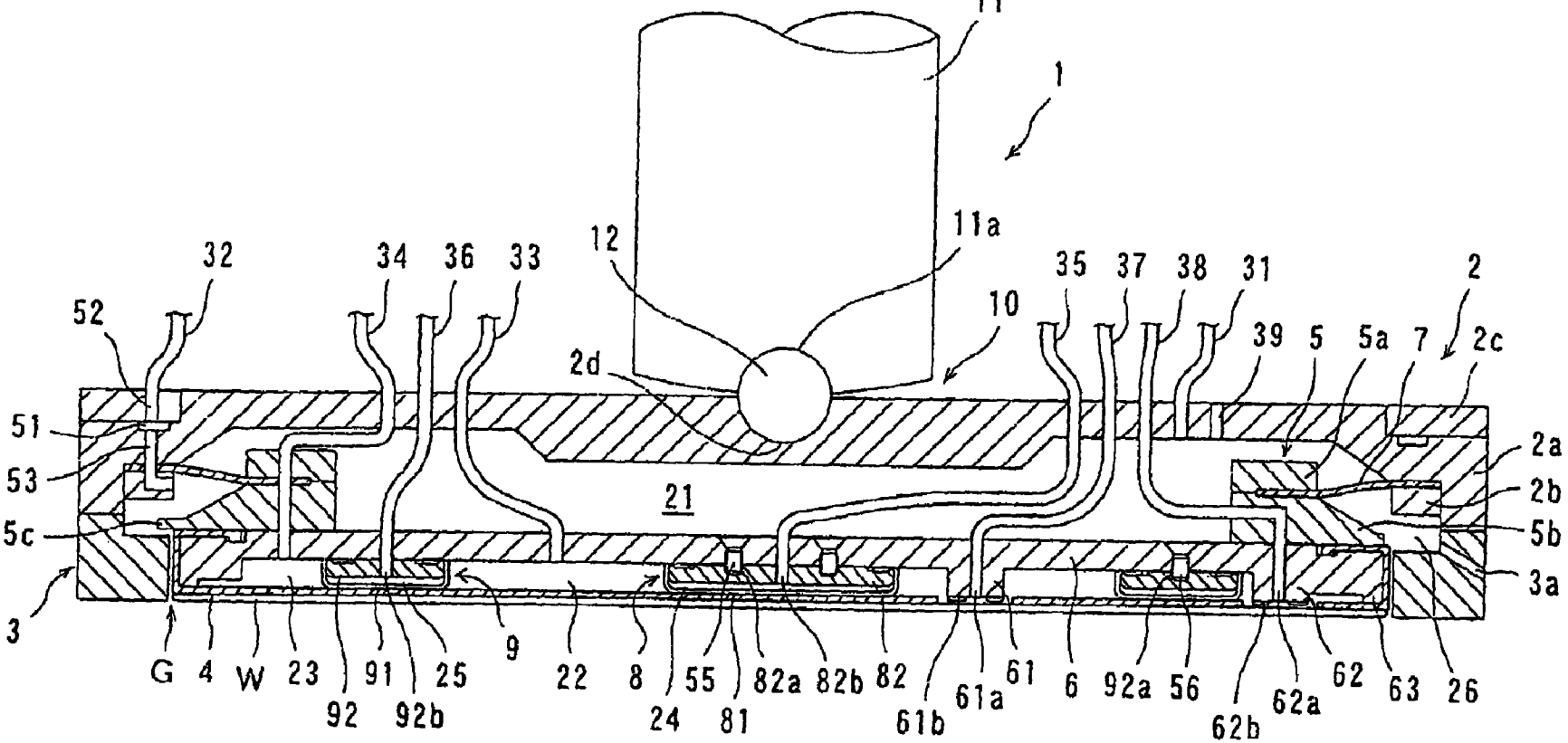
FIG. 2 is a vertical cross-sectional view showing a substrate holding apparatus according to the first embodiment of the present invention.
Figure 3:
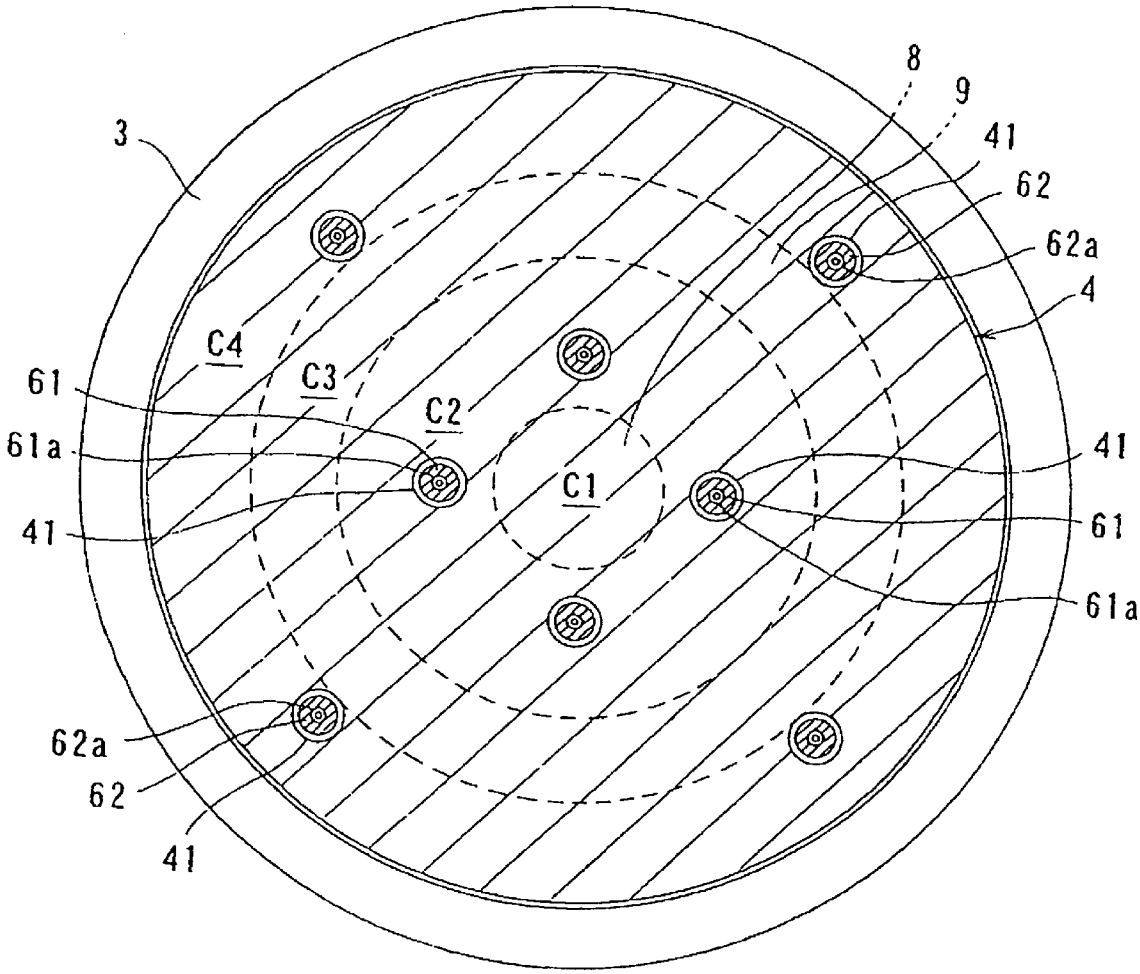
FIG. 3 is a bottom view of the substrate holding apparatus shown in FIG. 2.

The top ring 1 according to the first embodiment of the present invention will be described below. FIG. 2 is a vertical cross-sectional view showing the top ring 1 according to the first embodiment, and FIG. 3 is a bottom view of the top ring 1 shown in FIG. 2.

As shown in FIG. 2, the top ring 1 comprises the top ring body 2 in the form of a cylindrical housing with a storage space defined therein, and the retainer ring 3 fixed to the lower end of the top ring body 2. The top ring body 2 is made of a material having high strength and rigidity, such as metal or ceramic. The retainer ring 3 is made of highly rigid synthetic resin, ceramic, or the like.

The top ring body 2 comprises a cylindrical housing 2*a*, an annular pressurizing sheet support 2*b* fitted in the cylindrical housing 2*a*, and an annular seal 2*c* fitted over an outer circumferential edge of an upper surface of the cylindrical housing 2*a*. The retainer ring 3 is fixed to a lower end of the cylindrical housing 2*a* and has a lower portion projecting radially inwardly. The retainer ring 3 may be integrally formed with the top ring body 2.

The top ring drive shaft 11 is disposed above a center of the cylindrical housing 2*a*. The top ring body 2 is coupled to the top ring drive shaft 11 by the universal joint 10. The universal joint 10 has a spherical bearing mechanism by which the top ring body 2 and the top ring drive shaft 11 are tiltable with respect to each other, and a rotation transmitting mechanism for transmitting rotation of the top ring drive shaft 11 to the top ring body 2. The rotation transmitting mechanism and the spherical bearing mechanism transmit pressing and rotating forces from the top ring drive shaft 11 to the top ring body 2 while allowing the top ring body 2 and the top ring drive shaft 11 to be tilted with respect to each other.

The spherical bearing mechanism comprises a spherical recess 11*a* defined centrally in a lower surface of the top ring drive shaft 11, a spherical recess 2*d* defined centrally in an upper surface of the housing 2*a*, and a ball bearing 12 made of a hard material, such as ceramic, interposed between the spherical recesses 11*a* and 2*d*. The rotation transmitting mechanism comprises a drive pin (not shown) fixed to the top ring drive shaft 11, and a driven pin (not shown) fixed to the housing 2*a*. The drive pin is held in driving engagement with the driven pin while the drive pin and the driven pin are vertically movable relative to each other. Rotation of the top ring drive shaft 11 is transmitted to the top ring body 2 through the drive and driven pins. Even when the top ring body 2 is tilted with respect to the top ring drive shaft 11, the drive and driven pins remain in engagement with each other at a moving point of contact, so that torque of the top ring drive shaft 11 can reliably be transmitted to the top ring body 2.

The top ring body 2 and the retainer ring 3 secured to the top ring body 2 jointly have a space defined therein, which accommodates therein an elastic pad 4 having a lower end surface to be brought into contact with an upper surface of a semiconductor wafer W which is held by the top ring 1, an annular holder ring 5, and a disk-shaped chucking plate (support member) 6 for supporting the elastic pad 4. The elastic pad 4 has a radial outer edge clamped between the holder ring 5 and the chucking plate 6, is secured to a lower end of the holder ring 5, and extends radially inwardly so as to cover a lower surface of the chucking plate 6, thus forming a space between the elastic pad 4 and the chucking plate 6.

The chucking plate 6 may be made of metal. However, when the thickness of a thin film formed on a surface of a semiconductor wafer is measured by a method using eddy current in such a state that the semiconductor wafer to be polished is held by the top ring, the chucking plate 6 should preferably be made of a non-magnetic material, e.g., an insulating material such as fluororesin or ceramic.

A pressurizing sheet 7, which comprises an elastic membrane, extends between the holder ring 5 and the top ring body 2. The pressurizing sheet 7 is made of a highly strong and durable rubber material such as ethylene propylene rubber (ethylene-propylene terpolymer (EPDM)), polyurethane rubber, silicone rubber, or the like. The pressurizing sheet 7 has a radially outer edge clamped between the housing 2*a* and the pressurizing sheet support 2*b*, and a radially inner edge clamped between an upper portion 5*a* and a stopper 5*b* of the holder ring 5. The top ring body 2, the chucking plate 6, the holder ring 5, and the pressurizing sheet 7 jointly define a pressure chamber 21 in the top ring body 2. As shown in FIG. 2, a fluid passage 31 comprising tubes and connectors communicates with the pressure chamber 21, which is connected to the compressed air source 120 via a regulator R2 connected to the fluid passage 31.

In a case of a pressurizing sheet 7 made of an elastic material such as rubber, if the pressurizing sheet 7 is clamped between the retainer ring 3 and the top ring body 2, then the pressurizing sheet 7 is elastically deformed as an elastic material, and a desired horizontal surface cannot be maintained on a lower surface of the retainer ring 3. In order to maintain a desired horizontal surface on the lower surface of the retainer ring 3, the pressurizing sheet 7 is clamped between the housing 2*a* of the top ring body 2 and the pressurizing sheet support 2*b*, provided as a separate member in the present embodiment. The retainer ring 3 may vertically be movable with respect to the top ring body 2, or the retainer ring 3 may have a structure capable of pressing a polishing surface independently of the top ring 2, as disclosed in Japanese laid-open Patent Publication No. 9-168964 and Japanese Patent Application No. 11-294503 (corresponding to U.S. patent application Ser. No. 09/652,148). In such cases, the pressurizing sheet 7 is not necessarily fixed in the aforementioned manner.

A cleaning liquid passage 51 in the form of an annular groove is defined in the upper surface of the housing 2*a* near its outer circumferential edge over which the seal 2*c* is fitted. The cleaning liquid passage 51 communicates with a fluid passage 32 via a through hole 52 formed in the seal 2*c*, and is supplied with a cleaning liquid (pure water) via the fluid passage 32. A plurality of communication holes 53 are defined in the housing 2*a* and the pressurizing sheet support 2*b* in communication with the cleaning liquid passage 51. The communication holes 53 communicate with a small gap, G, defined between an outer circumferential surface of the elastic pad 4 and an inner circumferential surface of the retainer ring 3. The fluid passage 32 is connected to a cleaning liquid source (not shown) through a rotary joint (not shown).

The space defined between the elastic pad 4 and the chucking plate 6 accommodates therein a central bag 8 which functions as a central contact member to be brought into contact with the elastic pad 4, and a ring tube 9 which functions as an outer contact member to be brought into contact with the elastic pad 4. These contact members may be brought into abutment with the elastic pad 4. In the present embodiment, as shown in FIGS. 2 and 3, the central bag 8 has a circular contact surface, and is disposed centrally on a lower surface of the chucking plate. The ring tube 9 has an annular contact surface, and is disposed radially outwardly of the central bag 8 in surrounding relation thereto. Specifically, the central bag 8 and the ring tube 9 are spaced from each other at a predetermined interval. The elastic pad 4, the central bag 8, and the ring tube 9 are made of a highly strong and durable rubber material such as ethylene propylene rubber (ethylene-propylene terpolymer (EPDM)), polyurethane rubber, silicone rubber, or the like.

The space defined between the chucking plate 6 and the elastic pad 4 is divided into a plurality of spaces (second pressure chambers) by the central bag 8 and the ring tube 9. Specifically, a pressure chamber 22 is defined between the central bag 8 and the ring tube 9, and a pressure chamber 23 is defined radially outwardly of the ring tube 9.

The central bag 8 comprises an elastic membrane 81 to be brought into contact with the upper surface of the elastic pad 4, and a central bag holder (holding member) 82 for detachably holding the elastic membrane 81 in position. The central bag holder 82 has threaded holes 82*a* defined therein, and is detachably fastened to a center of the lower surface of the chucking plate 6 by screws 55 threaded into the threaded holes 82*a*. The central bag 8 has a central pressure chamber 24 (first pressure chamber) defined therein by the elastic membrane 81 and the central bag holder 82.

Similarly, the ring tube 9 comprises an elastic membrane 91 to be brought into contact with the upper surface of the elastic pad 4, and a ring tube holder (holding member) 92 for detachably holding the elastic membrane 91 in position. The ring tube holder 92 has threaded holes 92*a* defined therein, and is detachably fastened to the lower surface of the chucking plate 6 by screws 56 threaded into the threaded holes 92*a*. The ring tube 9 has an intermediate pressure chamber 25 (first pressure chamber) defined therein by the elastic membrane 91 and the ring tube holder 92.

Fluid passages 33, 34, 35 and 36 comprising tubes and connectors communicate with the pressure chambers 22, 23, the central pressure chamber 24, and the intermediate pressure chamber 25, respectively. The pressure chambers 22, 23, 24, and 25 are connected to the compressed air source 120 via respective regulators R3, R4, R5, and R6 connected respectively to the fluid passages 33, 34, 35, and 36. The fluid passages 31, 33, 34, 35 and 36 are connected to respective regulators R2, R3, R4, R5, and R6 through a rotary joint (not shown) mounted on an upper end of the top ring drive shaft 11.

The pressure chamber 21 above the chucking plate 6 and the pressure chambers 22 to 25 are supplied with a pressurized fluid (such as pressurized air or atmospheric air), or evacuated via the fluid passages 31, 33, 34, 35, and 36. As shown in FIG. 1, the regulators R2 to R6 connected to the fluid passages 31, 33, 34, 35, and 36 of the pressure chambers 21 to 25 can respectively regulate pressures of pressurized fluids supplied to the pressure chambers 21 to 25, for independently controlling pressures in the pressure chambers 21 to 25, or independently introducing atmospheric air or vacuum into the pressure chambers 21 to 25. Thus, pressures in the pressure chambers 21 to 25 are independently varied with the regulators R2 to R6 so that pressing forces, which are pressures per unit area for pressing the semiconductor wafer W against the polishing pad 101, can be adjusted in local areas of the semiconductor wafer W via the elastic pad 4. In some applications, the pressure chambers 21 to 25 may be connected to a vacuum source 121.

In this case, pressurized fluid or atmospheric air supplied to the pressure chambers 22 to 25 may independently be controlled in terms of temperature, for thereby directly controlling a temperature of the semiconductor wafer from the backside of the surface to be polished. Particularly, when each of the pressure chambers is independently controlled in terms of temperature, the rate of chemical reaction can be controlled during a chemical polishing process of CMP.

As shown in FIG. 3, a plurality of openings 41 are formed in the elastic pad 4. The chucking plate 6 has radially inner suction portions 61 and radially outer suction portions 62 extended downwardly therefrom. The openings 41 positioned between the central bag 8 and the ring tube 9 allow the inner suction portions 61 to be exposed externally, and the openings 41 positioned outside of the ring tube 9 allow the outer suction portions 62 to be exposed externally. In the present embodiment, the elastic pad 4 has eight openings 41 for allowing eight suction portions 61, 62 to be exposed.

Each of the inner suction portions 61 has a hole 61*a* communicating with a fluid passage 37, and each of the outer suction portions 62 has a hole 62*a* communicating with a fluid passage 38. Thus, each inner suction portion 61 and each outer suction portion 62 is connected to the vacuum source 121, such as a vacuum pump, via respective fluid passages 37, 38 and valves V1, V2. When the suction portions 61, 62 are evacuated by the vacuum source 121 to develop a negative pressure at lower opening ends of the communicating holes 61*a*, 62*a* thereof, a semiconductor wafer W is attracted to lower ends of the suction portions 61, 62 by the negative pressure. The suction portions 61, 62 have elastic sheets 61*b*, 62*b*, such as thin rubber sheets, attached to their lower ends, for elastically contacting and holding the semiconductor wafer W on lower surfaces thereof.

As shown in FIG. 2, when the semiconductor wafer W is polished, the lower ends of the suction portions 61, 62 are positioned above the lower surface of the elastic pad 4, without projecting downwardly from the lower surface of the elastic pad 4. When the semiconductor wafer W is attracted to the suction portions 61, 62, the lower ends of the suction portions 61, 62 are positioned at the same level as the lower surface of the elastic pad 4.

Since there is the small gap, G, between the outer circumferential surface of the elastic pad 4 and the inner circumferential surface of the retainer ring 3, the holder ring 5, the chucking plate 6, and the elastic pad 4 attached to the chucking plate 6 can be moved vertically with respect to the top ring body 2 and the retainer ring 3 and, hence, are of a floating structure with respect to the top ring body 2 and the retainer ring 3. A plurality of teeth 5*c* project radially outwardly from an outer circumferential edge of the stopper 5*b* of the holder ring 5. When the teeth 5*c* engage an upper surface of a radially inwardly projecting portion of the retainer ring 3 upon downward movement of the holder ring 5, the holder ring 5 is prevented from moving further down.

Operation of the top ring 1 thus constructed will be described below.

When the semiconductor wafer W is to be delivered to the polishing apparatus, the top ring 1 is moved to a position to which the semiconductor wafer W is transferred, and the communicating holes 61*a*, 62*a* of the suction portions 61, 62 are evacuated via the fluid passages 37, 38 by the vacuum source 121. The semiconductor wafer W is attracted to the lower ends of the suction portions 61, 62 by a suction effect of the communicating holes 61*a*, 62*a*. With the semiconductor wafer W attracted to the top ring 1, the top ring 1 is moved to a position above the polishing table 100 having the polishing surface (polishing pad 101) thereon. The retainer ring 3 holds an outer circumferential edge of the semiconductor wafer W so that the semiconductor wafer W is not removed from the top ring 1.

For polishing the lower surface of the semiconductor wafer W, the semiconductor wafer W is held on the lower surface of the top ring 1, and the top ring air cylinder 111 connected to the top ring drive shaft 11 is actuated to press the retainer ring 3, fixed to the lower end of the top ring body 2, against the polishing surface on the polishing table 100 under a predetermined pressure. Then, pressurized fluids are respectively supplied to the pressure chambers 22, 23, the central pressure chamber 24, and the intermediate pressure chamber 25 under respective pressures, thereby pressing the semiconductor wafer W against the polishing surface on the polishing table 100. The polishing liquid supply nozzle 102 then supplies the polishing liquid Q onto the polishing pad 101. Thus, the semiconductor wafer W is polished by the polishing pad 101 with the polishing liquid Q being present between the lower surface, to be polished, of the semiconductor wafer W and the polishing pad 101.

Local areas of the semiconductor wafer W that are positioned beneath the pressure chambers 22, 23 are pressed against the polishing pad 101 under pressures of pressurized fluids supplied to the pressure chambers 22, 23. A local area of the semiconductor wafer W that is positioned beneath the central pressure chamber 24 is pressed via the elastic membrane 81 of the central bag 8 and the elastic pad 4 against the polishing pad 101 under pressure of pressurized fluid supplied to the central pressure chamber 24. A local area of the semiconductor wafer W that is positioned beneath the intermediate pressure chamber 25 is pressed via the elastic membrane 91 of the ring tube 9 and the elastic pad 4 against the polishing pad 101 under pressure of pressurized fluid supplied to the intermediate pressure chamber 25.

Therefore, polishing pressures acting on respective local areas of the semiconductor wafer W can be adjusted independently by controlling pressures of pressurized fluids supplied to each of the pressure chambers 22 to 25. Specifically, each of the regulators R3 to R6 independently regulates pressure of pressurized fluid supplied to the pressure chambers 22 to 25 for thereby adjusting pressing forces applied to press the local areas of the semiconductor wafer W against the polishing pad 101 on the polishing table 100. With the polishing pressures on the respective local areas of the semiconductor wafer W being adjusted independently, the semiconductor wafer W is pressed against the polishing pad 101 on the polishing table 100 that is being rotated. Similarly, pressure of pressurized fluid supplied to the top ring air cylinder 111 can be regulated by the regulator R1 to adjust a force with which the retainer ring 3 presses the polishing pad 101. While the semiconductor wafer W is being polished, the force with which the retainer ring 3 presses the polishing pad 101 and the pressing force with which the semiconductor wafer W is pressed against the polishing pad 101 can appropriately be adjusted for thereby applying polishing pressures in a desired pressure distribution to a central area C1, an inner area C2, an intermediate area C3, and a peripheral area C4 of the semiconductor wafer W (see FIG. 3).

The local areas of the semiconductor wafer W that are positioned beneath the pressure chambers 22, 23 are divided into areas to which a pressing force from a fluid is applied via the elastic pad 4, and areas to which pressure of a pressurized fluid is directly applied, such as areas positioned beneath the openings 41. However, pressing forces applied to these two areas are equal to each other. When the semiconductor wafer W is polished, the elastic pad 4 is brought into close contact with the upper surface of the semiconductor wafer W near the openings 41, so that the pressurized fluids supplied to the pressure chambers 22, 23 are prevented from flowing out to an exterior.

In this manner, the semiconductor wafer W is divided into concentric circular and annular areas C1 to C4, which can be pressed under independent pressing forces. Polishing rates of the circular and annular areas C1 to C4, which depend on pressing forces applied to those areas, can be independently controlled because the pressing forces applied to those areas can independently be controlled. Consequently, even if a thickness of a thin film to be polished on a surface of the semiconductor wafer W suffers radial variations, the thin film on the surface of the semiconductor wafer W can be polished uniformly without being insufficiently or excessively polished. More specifically, even if a thickness of a thin film to be polished on a surface of the semiconductor wafer W differs depending on a radial position on the semiconductor wafer W, pressure in a pressure chamber positioned over a thicker area of the thin film is made higher than pressure in a pressure chamber positioned over a thinner area of the thin film, or pressure in a pressure chamber positioned over a thinner area of the thin film is made lower than pressure in a pressure chamber positioned over a thicker area of the thin film. In this manner, a pressing force applied to the thicker area of the thin film is made higher than a pressing force applied to the thinner area of the thin film, thereby selectively increasing a polishing rate of the thicker area of the thin film. Consequently, an entire surface of the semiconductor wafer W can be polished exactly to a desired level irrespective of a film thickness distribution obtained at a time the thin film is formed.

Any unwanted edge rounding on a circumferential edge of the semiconductor wafer W can be prevented by controlling a pressing force applied to the retainer ring 3. If a thin film to be polished on a circumferential edge of the semiconductor wafer W has large thickness variations, then a pressing force applied to the retainer ring 3 is intentionally increased or reduced to thus control a polishing rate of the circumferential edge of the semiconductor wafer W. When pressurized fluids are supplied to the pressure chambers 22 to 25, the chucking plate 6 is subjected to upward forces. In the present embodiment, pressurized fluid is supplied to the pressure chamber 21 via the fluid passage 31 to prevent the chucking plate 6 from being lifted under forces from the pressure chambers 22 to 25.

As described above, the pressing force applied by the top ring air cylinder 111 to press the retainer ring 3 against the polishing pad 101, and the pressing forces applied by the pressurized fluids supplied to the pressure chambers 22 to 25 to press the local areas of the semiconductor wafer W against the polishing pad 101, are appropriately adjusted to polish the semiconductor wafer W. When polishing of the semiconductor wafer W is finished, the semiconductor wafer W is attracted to the lower ends of the suction portions 61, 62 under vacuum in the same manner as described above. At this time, supply of the pressurized fluids into the pressure chambers 22 to 25 is stopped, and the pressure chambers 22 to 25 are vented to an atmosphere. Accordingly, the lower ends of the suction portions 61, 62 are brought into contact with the semiconductor wafer W. The pressure chamber 21 is vented to the atmosphere or evacuated to develop a negative pressure therein. If the pressure chamber 21 is maintained at a high pressure, then the semiconductor wafer W is strongly pressed against the polishing surface only in areas brought into contact with the suction portions 61, 62. Therefore, it is necessary to decrease pressure in the pressure chamber 21 immediately. Accordingly, a relief port 39 penetrating through the top ring body 2 may be provided for decreasing pressure in the pressure chamber 21 immediately, as shown in FIG. 2. In this case, when the pressure chamber 21 is pressurized, it is necessary to continuously supply pressurized fluid into the pressure chamber 21 via the fluid passage 31. The relief port 39 comprises a check valve (not shown) for preventing an outside air from flowing into the pressure chamber 21 at a time when a negative pressure is developed in the pressure chamber 21.

After the semiconductor wafer W is attracted to the lower ends of the suction portions 61, 62, the top ring 1 is moved to a position to which the semiconductor wafer W is to be transferred. Then, a fluid such as compressed air or a mixture of nitrogen and pure water is ejected to the semiconductor wafer W via the communicating holes 61*a*, 62*a* of the suction portions 61, 62 to release the semiconductor wafer W from the top ring 1.

The polishing liquid Q used to polish the semiconductor wafer W tends to flow through the gap G between the outer circumferential surface of the elastic pad 4 and the retainer ring 3. If the polishing liquid Q is firmly deposited in the gap G, then the holder ring 5, the chucking plate 6, and the elastic pad 4 are prevented from smoothly moving vertically with respect to the top ring body 2 and the retainer ring 3. To avoid such a drawback, a cleaning liquid (pure water) is supplied through the fluid passage 32 to the cleaning liquid passage 51. Accordingly, pure water is supplied via the communication holes 53 to a region above the gap G, thus cleaning members defining the gap G to remove deposits of the polishing liquid Q. Preferably, the pure water should be supplied after a polished semiconductor wafer W is released until a next semiconductor wafer is attracted to the top ring 1. It is also preferable to discharge all supplied pure water out of the top ring 1 before the next semiconductor wafer is polished, and to provide the retainer ring 3 with a plurality of through holes 3*a*, as shown in FIG. 2, for discharging the pure water. Furthermore, if a pressure buildup is developed in a space 26 defined between the retainer ring 3, the holder ring 5, and the pressurizing sheet 7, prevents the chucking plate 6 from being elevated in the top ring body 2. Therefore, in order to allow the chucking plate 6 to be elevated smoothly in the top ring body 2, the through holes 3*a* should be provided for equalizing pressure in the space 26 with atmospheric pressure.

As described above, according to the present invention, pressures in the pressure chambers 22, 23, the pressure chamber 24 in the central bag 8, and the pressure chamber 25 in the ring tube 9 are independently controlled to control pressing forces acting on the semiconductor wafer W.

Further, according to the present invention, regions in which a pressing force applied to the semiconductor wafer W is controlled can be easily changed by changing positions or sizes of the central bag 8 and the ring tube 9. Examples of changing regions in which a pressing force applied to the semiconductor wafer W is controlled will be described below.

FIGS. 4A through 4E and FIG. 5 are vertical cross-sectional views showing other examples of the contact members (central bag 8 and ring tube 9) in the substrate holding apparatus according to the present invention.

Figure 4A:
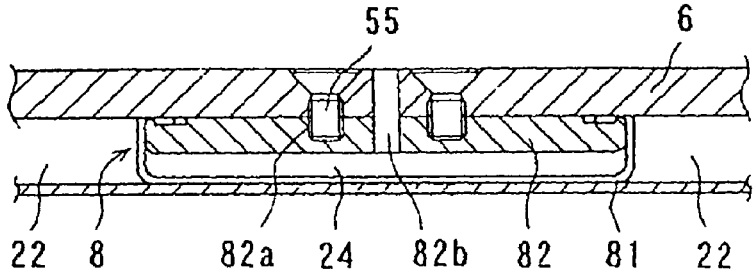
FIGS. 4A through 4E are vertical cross-sectional views showing other examples of contact members (central bag and ring tube) in a substrate holding apparatus according to the present invention.
Figure 4B:
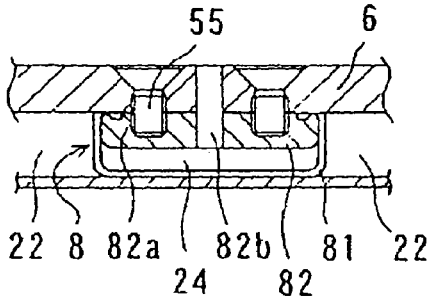

As shown in FIGS. 4A and 4B, area C1 in which a pressing force applied to a semiconductor wafer is controlled can be changed by utilizing another central bag 8 having a different size. In this case, when a size and shape of a hole 82*b* for allowing pressure chamber 24 defined in central bag 8 to communicate with the fluid passage 35, and a size and position of threaded holes 82*a* for mounting central bag holder 82 on the chucking plate 6 are predetermined, a range in which a pressing force applied to a semiconductor wafer is controlled can be changed simply by preparing a central bag holder 82 having a different size. In this case, it is not necessary to modify the chucking plate 6.

Figure 4C:
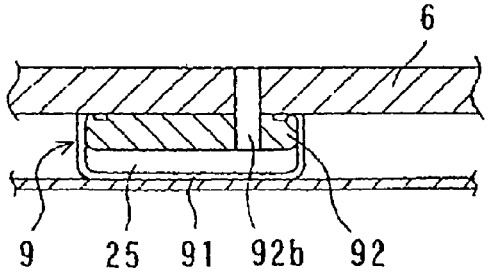
Figure 4D:
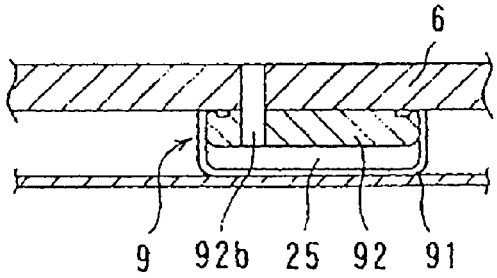
Figure 4E:
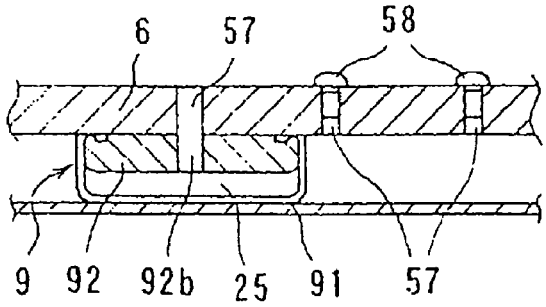

As shown in FIGS. 4C and 4D, a width and/or position of area C3 in which a pressing force applied to a semiconductor wafer is controlled can be changed by utilizing another ring tube 9 having a different size and/or shape. Further, as shown in FIG. 4E, a plurality of holes 57 and threaded holes (not shown) may be provided at predetermined radial positions of the chucking plate 6. In this case, communicating hole 92*b* is positioned at a position corresponding to one of the holes 57, and the other holes 57 (and threaded holes) are filled with screws 58 for sealing fluids. Thus, the ring tube 9 can flexibly be mounted in a radial direction, so that a region in which a pressing force is controlled can flexibly be changed.

Figure 5:
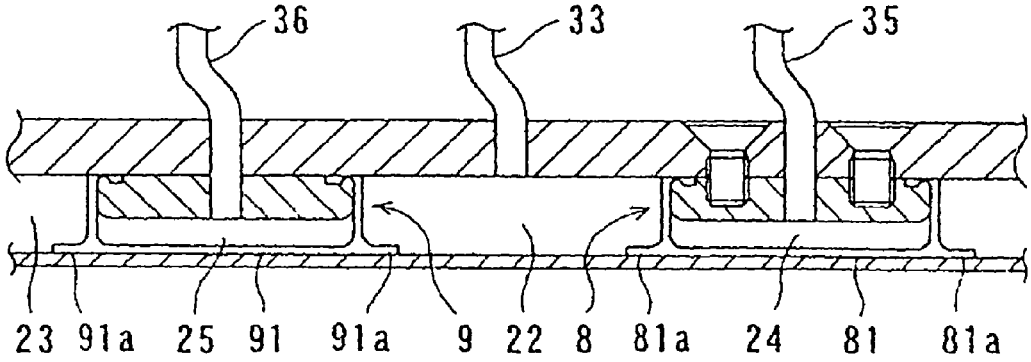
FIG. 5 is a vertical cross-sectional view showing another example of contact members (central bag and ring tube) in a substrate holding apparatus according to the present invention.

As shown in FIG. 5, a protrusion 81*a* extending radially outwardly from a circumferential edge of the elastic membrane 81 may be provided on a lower surface of the central bag 8, and protrusions 91*a* extending radially from circumferential edges of the elastic membrane 91 may be provided on a lower surface of the ring tube 9. The protrusions 81*a*, 91*a* are made of the same material as that of the central bag 8 and the ring tube 9. As described above, when a semiconductor wafer is polished, pressurized fluids are supplied to the pressure chamber 22 positioned between the central bag 8 and the ring tube 9, and the pressure chamber 23 surrounding the ring tube 9. Therefore, the protrusions 81*a*, 91*a* are brought into close contact with the elastic pad 4 by the pressurized fluids supplied to the pressure chambers 22, 23. Thus, even if pressure of pressurized fluid supplied to the pressure chamber 22 adjacent to the central bag 8 is considerably higher than pressure of pressurized fluid supplied to the pressure chamber 24 defined in the central bag 8, high-pressure fluid adjacent to the central bag 8 is prevented from flowing into a lower portion of the central bag 8. Similarly, even if pressure of pressurized fluid supplied to the pressure chamber 22 or 23 adjacent to the ring tube 9 is considerably higher than pressure of pressurized fluid supplied to the pressure chamber 25 defined in the ring tube 9, high-pressure fluid adjacent to the ring tube 9 is prevented from flowing into a lower portion of the ring tube 9. Therefore, the protrusions 81*a*, 91*a* can widen a range of pressure control in each of the pressure chambers, for thereby pressing the semiconductor wafer more stably.

Figure 6A:
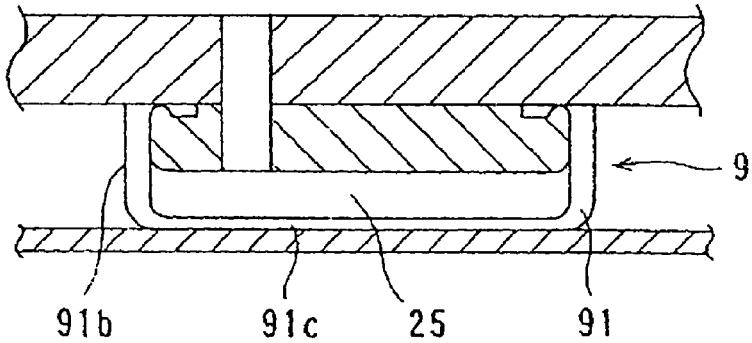
FIGS. 6A and 6B are vertical cross-sectional views showing other examples of contact members (central bag and ring tube) in a substrate holding apparatus according to the present invention.
Figure 6B:
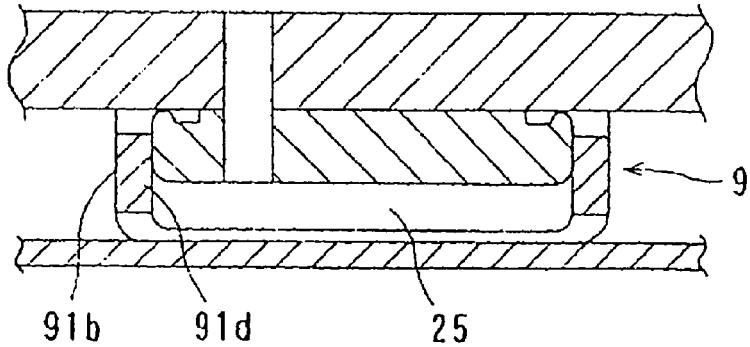

The elastic membranes 81, 91 may each have differing thicknesses or may partially include an inelastic member. FIG. 6A shows an example in which the elastic membrane 91 of the ring tube 9 has side surfaces 91*b* thicker than a surface to be brought into contact with the elastic pad 4. FIG. 6B shows an example in which the elastic membrane 91 of the ring tube 9 partially includes inelastic members 91*d* in side surfaces thereof. In these examples, deformation of the side surfaces of the elastic membrane due to pressure in the pressure chambers can appropriately be limited.

As described above, a distribution of a thin film formed on a surface of a semiconductor wafer varies depending on a deposition method or a deposition apparatus employed. According to the present invention, a substrate holding apparatus can change a position and size of the pressure chambers for applying pressing forces to the semiconductor wafer simply by changing central bag 8 and central bag holder 82, or ring tube 9 and ring tube holder 92. Therefore, a position and region in which a pressing force is controlled can easily be changed in accordance with distribution of a thin film to be polished at low cost. In other words, the substrate holding apparatus can cope with various thickness distributions of a thin film formed on a semiconductor wafer to be polished. Change of shape and position of the central bag 8 or the ring tube 9 leads to a change of size of the pressure chamber 22 positioned between the central bag 8 and the ring tube 9, and the pressure chamber 23 surrounding the ring tube 9.

Figure 7:
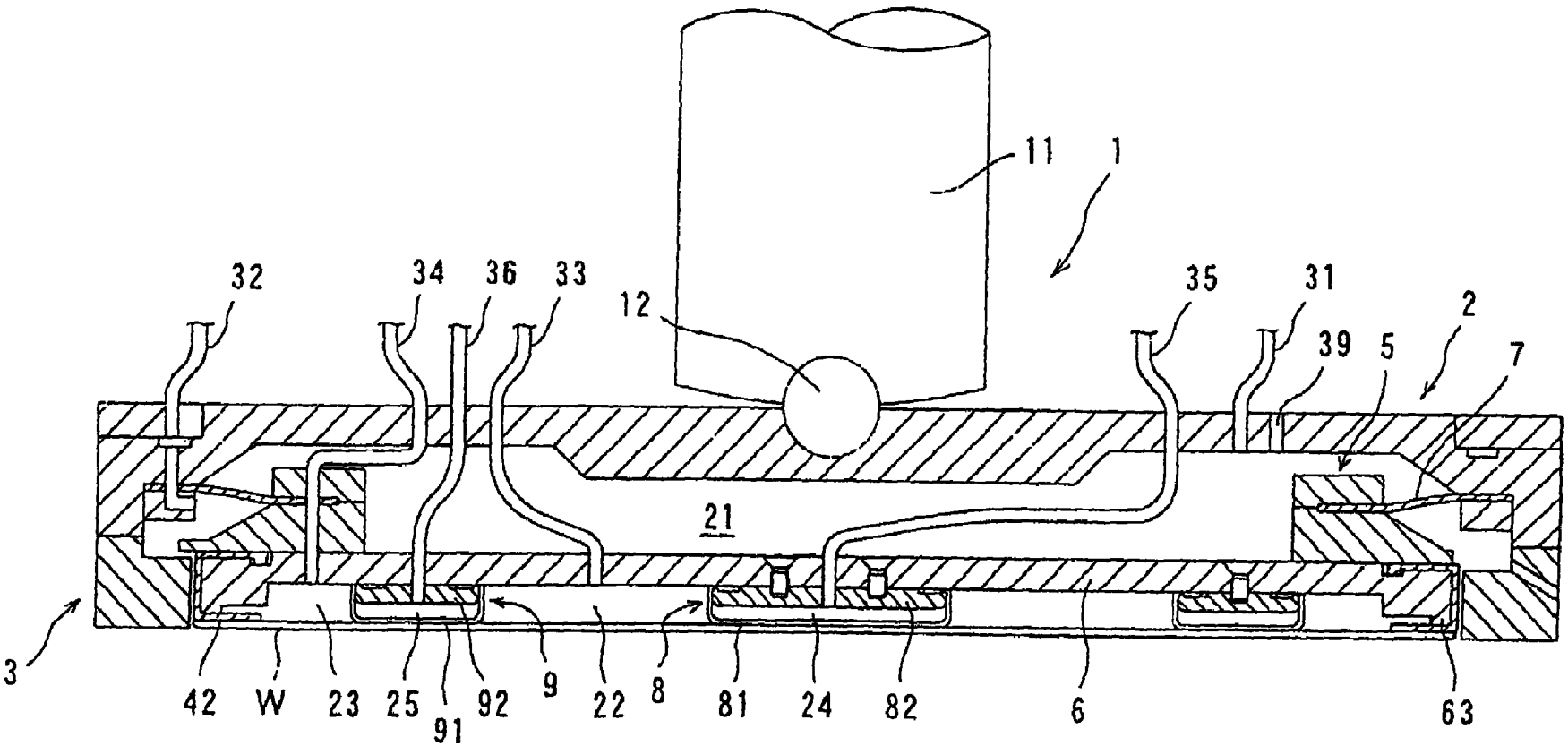
FIG. 7 is a vertical cross-sectional view showing a substrate holding apparatus according to a second embodiment of the present invention.

A polishing apparatus according to a second embodiment of the present invention will be described below with reference to FIGS. 7 through 11. FIG. 7 is a vertical cross-sectional view showing a top ring 1 according to the second embodiment. Like parts and components are designated by the same reference numerals and characters as those in the first embodiment.

In the second embodiment, as shown in FIG. 7, the top ring 1 has a seal ring 42 instead of an elastic pad. The seal ring 42 comprises an elastic membrane covering only a lower surface of a chucking plate 6 near its outer circumferential edge. In the second embodiment, neither an inner suction portion (indicated by the reference numeral 61 in FIG. 2) nor an outer suction portion (indicated by the reference numeral 62 in FIG. 2) is provided on the chucking plate 6, for a simple configuration. However, suction portions for attracting a semiconductor wafer may be provided on the chucking plate 6, as with the first embodiment. The seal ring 42 is made of a highly strong and durable rubber material such as ethylene propylene rubber (ethylene-propylene terpolymer (EPDM)), polyurethane rubber, silicone rubber, or the like.

The seal ring 42 is provided such that a lower surface of the seal ring 42 is brought into contact with an upper surface of semiconductor wafer W. The seal ring 42 has a radially outer edge clamped between the chucking plate 6 and a holder ring 5, as with the elastic pad 4 in the first embodiment. The semiconductor wafer W has a recess defined in an outer edge thereof, which is referred to as a notch or orientation flat, for recognizing or identifying an orientation of the semiconductor wafer. Therefore, the seal ring 42 should preferably extend radially inwardly from an innermost position of the recess, i.e. the notch or orientation flat.

A central bag 8 is disposed centrally on a lower surface of the chucking plate 6, and a ring tube 9 is disposed radially outwardly of the central bag 8 in surrounding relation thereto, as with the first embodiment.

In the second embodiment, the semiconductor wafer W is held by the top ring 1 such that the semiconductor wafer W is brought into contact with the seal ring 42, an elastic membrane 81 of the central bag 8, and an elastic membrane 91 of the ring tube 9. Therefore, the semiconductor wafer W, the chucking plate 6, and the seal ring 42 jointly define a space therebetween, instead of the space defined by the elastic pad and the chucking plate in the first embodiment. This space is divided into a plurality of spaces (second pressure chambers) by the central bag 8 and the ring tube 9. Specifically, a pressure chamber 22 is defined between the central bag 8 and the ring tube 9, and a pressure chamber 23 is defined radially outwardly of the ring tube 9.

Fluid passages 33, 34, 35 and 36 comprising tubes and connectors communicate with the pressure chambers 22, 23, a central pressure chamber (first pressure chamber) 24 defined in the central bag 8, and an intermediate pressure chamber (first pressure chamber) 25 defined in the ring tube 9, respectively. The pressure chambers 22, 23, 24, and 25 are connected to a compressed air source via respective regulators connected respectively to the fluid passages 33, 34, 35, and 36. The regulators connected to fluid passages 31, 33, 34, 35 and 36 of pressure chambers 21 to 25 can respectively regulate pressures of pressurized fluids supplied to the pressure chambers 21 to 25 for independently controlling pressures in the pressure chambers 21 to 25, or independently introducing atmospheric air or vacuum into the pressure chambers 21 to 25. Thus, pressures in the pressure chambers 21 to 25 are independently varied with the regulators, so that the pressing forces can be adjusted in local areas of the semiconductor wafer W. In some applications, the pressure chambers 21 to 25 may be connected to a vacuum source 121.

Operation of the top ring 1 thus constructed will be described below.

When the semiconductor wafer W is to be delivered to the polishing apparatus, the top ring 1 is moved to a position to which the semiconductor wafer W is delivered, and the central bag 8 and the ring tube 9 are supplied with a pressurized fluid under a predetermined pressure for bringing lower surfaces of the central bag 8 and the ring tube 9 into close contact with an upper surface of the semiconductor wafer W. Thereafter, the pressure chambers 22, 23 are connected to a vacuum source via the fluid passages 33, 34 to develop a negative pressure in the pressure chambers 22, 23 for thereby attracting the semiconductor wafer W under vacuum.

For polishing a lower surface of the semiconductor wafer W, the semiconductor wafer W is held on a lower surface of the top ring 1, and top ring air cylinder 111 connected to top ring drive shaft 11 is actuated to press retainer ring 3, fixed to a lower end of top ring body 2, against a polishing surface on polishing table 100 under a predetermined pressure. Then, pressurized fluids are respectively supplied to the pressure chambers 22, 23, the central pressure chamber 24, and the intermediate pressure chamber 25 under respective pressures, thereby pressing the semiconductor wafer W against the polishing surface on the polishing table 100. Polishing liquid supply nozzle 102 then supplies polishing liquid Q onto polishing pad 101. Thus, the semiconductor wafer W is polished by the polishing pad 101 with the polishing liquid Q being present between the lower surface of the semiconductor wafer W and the polishing pad 101.

Local areas of the semiconductor wafer W that are positioned beneath the pressure chambers 22, 23 are pressed against the polishing pad 101 under the pressures of the pressurized fluids supplied to the pressure chambers 22, 23. A local area of the semiconductor wafer W that is positioned beneath the central pressure chamber 24 is pressed via the elastic membrane 81 of the central bag 8 against the polishing pad 101 under the pressure of the pressurized fluid supplied to the central pressure chamber 24. A local area of the semiconductor wafer W that is positioned beneath the intermediate pressure chamber 25 is pressed via the elastic membrane 91 of the ring tube 9 against the polishing pad 101 under the pressure of the pressurized fluid supplied to the intermediate pressure chamber 25.

Therefore, polishing pressures acting on respective local areas of the semiconductor wafer W can be adjusted independently by controlling pressures of pressurized fluids supplied to each of the pressure chambers 22 to 25. Thus, the semiconductor wafer W is divided into concentric circular and annular areas, which can be pressed under independent pressing forces. Polishing rates of the circular and annular areas, which depend on pressing forces applied to those areas, can independently be controlled because pressing forces applied to those areas can independently be controlled. Consequently, even if a thickness of a thin film to be polished on a surface of the semiconductor wafer W suffers radial variations, the thin film on the surface of the semiconductor wafer W can be polished uniformly without being insufficiently or excessively polished. More specifically, even if a thickness of a thin film to be polished on a surface of the semiconductor wafer W differs depending on a radial position on the semiconductor wafer W, pressure in a pressure chamber positioned over a thicker area of the thin film is made higher than pressure in a pressure chamber positioned over a thinner area of the thin film, or pressure in a pressure chamber positioned over a thinner area of the thin film is made lower than pressure in a pressure chamber positioned over a thicker area of the thin film. In this manner, a pressing force applied to the thicker area of the thin film is made higher than a pressing force applied to the thinner area of the thin film, thereby selectively increasing a polishing rate of the thicker area of the thin film. Consequently, an entire surface of the semiconductor wafer W can be polished exactly to a desired level irrespective of a film thickness distribution obtained at a time the thin film is formed.

When the semiconductor wafer W is polished, the seal ring 42 is brought into close contact with a part of an upper surface of the semiconductor wafer for thereby sealing this space. Hence, pressurized fluid is prevented from flowing out to an exterior of the pressure chamber 23.

When polishing of the semiconductor wafer W is finished, the semiconductor wafer W is attracted under vacuum in the same manner as described above, and then the pressure chamber 21 is vented to an atmosphere or evacuated to develop a negative pressure therein. After the semiconductor wafer W is attracted, the top ring 1 is moved to a position from which the semiconductor wafer W is to be delivered. Then, a fluid such as compressed air or a mixture of nitrogen and pure water is ejected to the semiconductor wafer W via the fluid passages 33, 34 to release the semiconductor wafer W from the top ring 1. If the elastic membrane 81 of the central bag 8 and the elastic membrane 91 of the ring tube 9 have through holes defined in their lower surfaces, then, the semiconductor wafer W can be smoothly released from the top ring 1 since downward forces are applied to the semiconductor wafer W by fluid flowing through these through holes. After the semiconductor wafer W is released from the top ring 1, most of lower surfaces of the top ring 1 are exposed. Therefore, the lower surfaces of the top ring 1 can be cleaned relatively easily after the semiconductor wafer W is polished and released.

Figure 8:
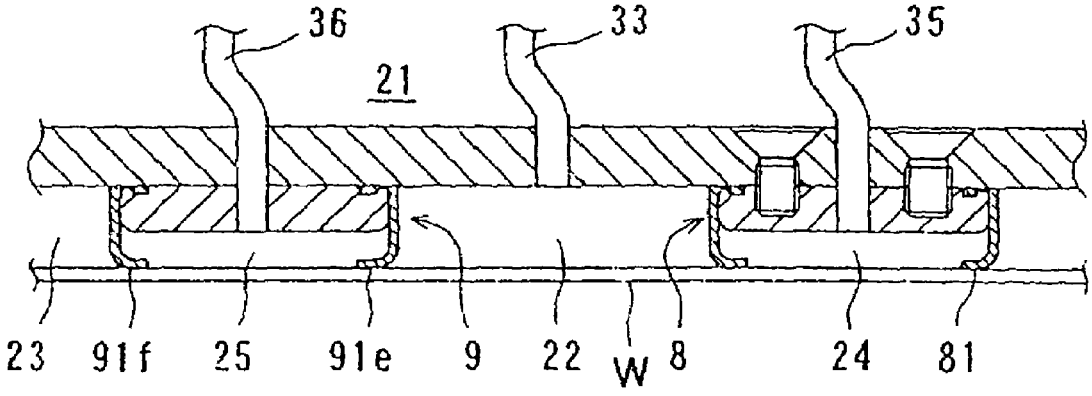
FIG. 8 is a vertical cross-sectional view showing another example of contact members (central bag and ring tube) in a substrate holding apparatus according to the present invention.

Other examples of the central bag 8 and the ring tube 9 in the substrate holding apparatus according to the present invention will be described below. FIG. 8 is a vertical cross-sectional view showing another example of the present invention, and FIG. 9 is a bottom view of FIG. 8 in such a state that a semiconductor wafer W is removed.

Figure 9:
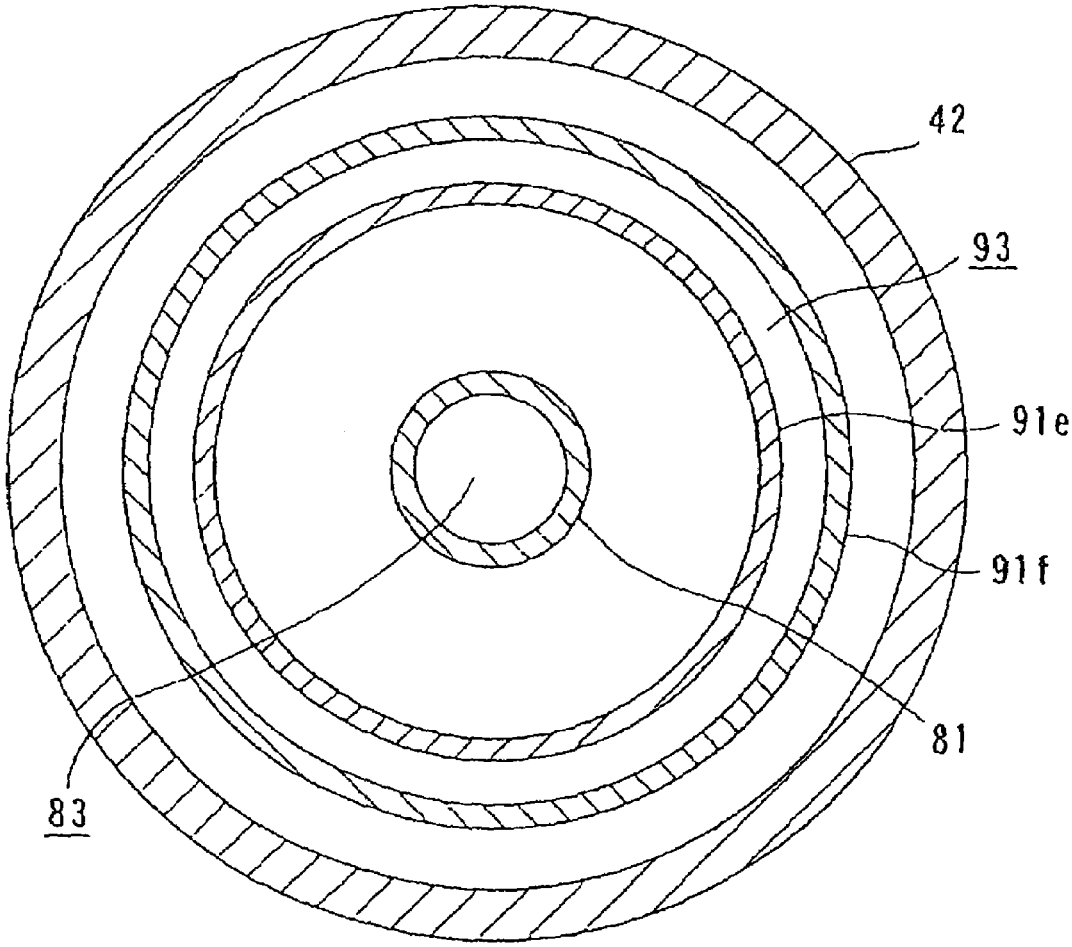
FIG. 9 is a bottom view of the substrate holding apparatus shown in FIG. 8 in such a state that a semiconductor wafer is removed.

In this example, as shown in FIGS. 8 and 9, a central bag 8 has an elastic membrane 81 only at an outer circumferential edge of the central bag 8, and a circular hole (communicating portion) 83 is formed in a lower surface of the elastic membrane 81 of the central bag 8. A ring tube 9 has two elastic membranes, i.e., a radially inner elastic membrane 91*e* and a radially outer elastic membrane 91*f*, and an annular groove (communicating portion) 93 is formed between the inner elastic membrane 91*e* and the outer elastic membrane 91*f*. Pressurized fluids supplied to central pressure chamber 24 and intermediate pressure chamber 25 contact an upper surface, which is a contact surface, of the semiconductor wafer W.

When pressurized fluids supplied to the central pressure chamber 24 and the intermediate pressure chamber 25 are controlled in terms of temperature, and a temperature of the semiconductor wafer W is controlled from a backside of the surface to be polished, as described above, the communicating portions 83, 93 formed in the lower surfaces of the elastic membranes of the central bag 8 and the ring tube 9 can increase an area in which pressurized fluid controlled in terms of temperature is brought into contact with the semiconductor wafer W. Therefore, control of the temperature of the semiconductor wafer W can be improved. Further, when polishing of the semiconductor wafer W is finished and the semiconductor wafer W is released, the central pressure chamber 24 and the intermediate pressure chamber 25 are respectively opened to outside air via the circular hole 83 and the annular groove 93. Thus, fluids supplied into the central pressure chamber 24 and the intermediate pressure chamber 25 are prevented from remaining in the central pressure chamber 24 and the intermediate pressure chamber 25. Therefore, even when semiconductor wafers W are continuously polished, control of the temperature of each semiconductor wafer W can be maintained.

When a semiconductor wafer W is polished, pressurized fluids are supplied to the central pressure chamber 24 and the intermediate pressure chamber 25. Therefore, the lower surface of the elastic membrane 81 of the central bag 8 and the lower surface of the inner and outer elastic membranes 91*e*, 91*f* of the ring tube 9 are pressed against an upper surface, which is the contact surface, of the semiconductor wafer W. Accordingly, even though the circular hole 83 and the annular groove 93 are formed in the elastic membranes, pressurized fluids supplied to the central pressure chamber 24 and the intermediate pressure chamber 25 are prevented from flowing out to an exterior.

Figure 10:
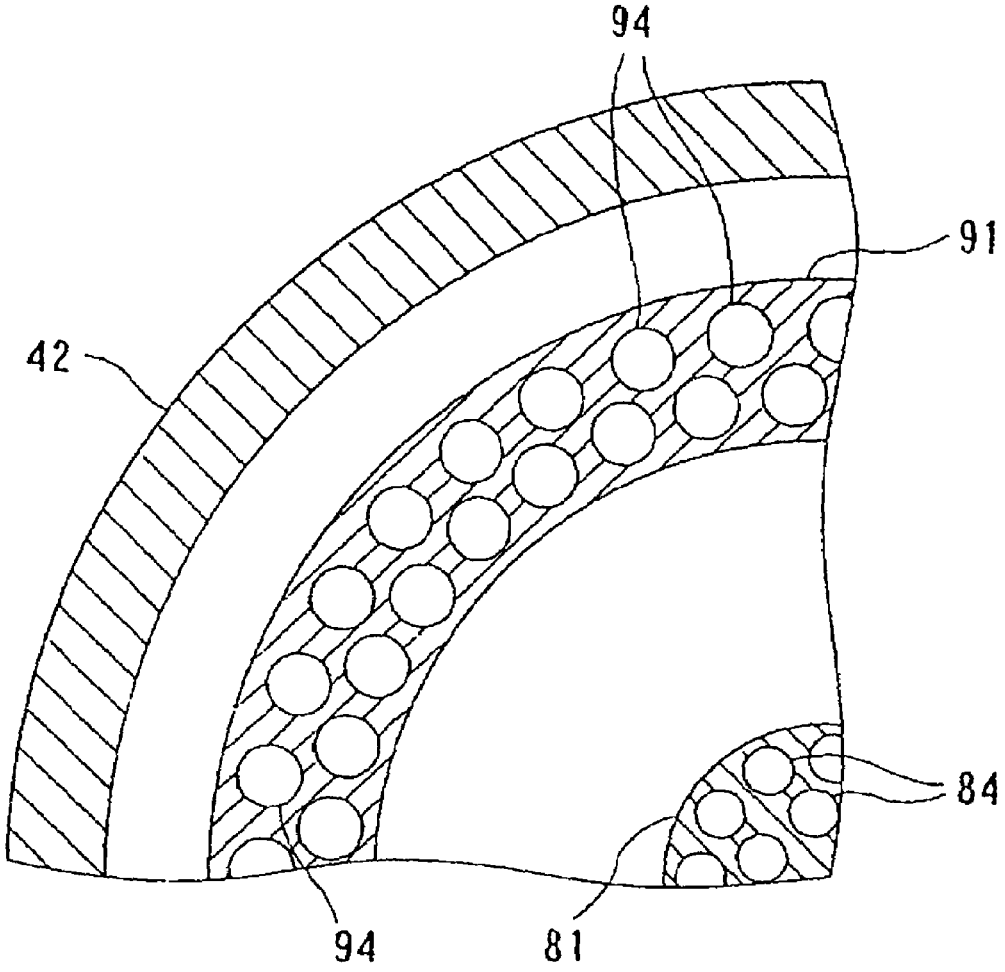
FIG. 10 is a bottom view showing another example of contact members (central bag and ring tube) in a substrate holding apparatus according to the present invention.

In the example shown in FIGS. 8 and 9, a force that causes the circular hole 83 to expand outwardly acts on the elastic membrane 81 of the central bag 8 due to pressurized fluid supplied to the central pressure chamber 24. A force that causes the annular groove 93 to expand outwardly acts on the elastic membranes 91*e*, 91*f* of the ring tube 9 due to pressurized fluid supplied to the intermediate pressure chamber 25. In order to disperse these forces, a plurality of circular holes (communicating portions) 84, 94 may be provided on the lower surface of the elastic membrane 81, 91 of the central bag 8 and the ring tube 9, as shown in FIG. 10.

Figure 11:
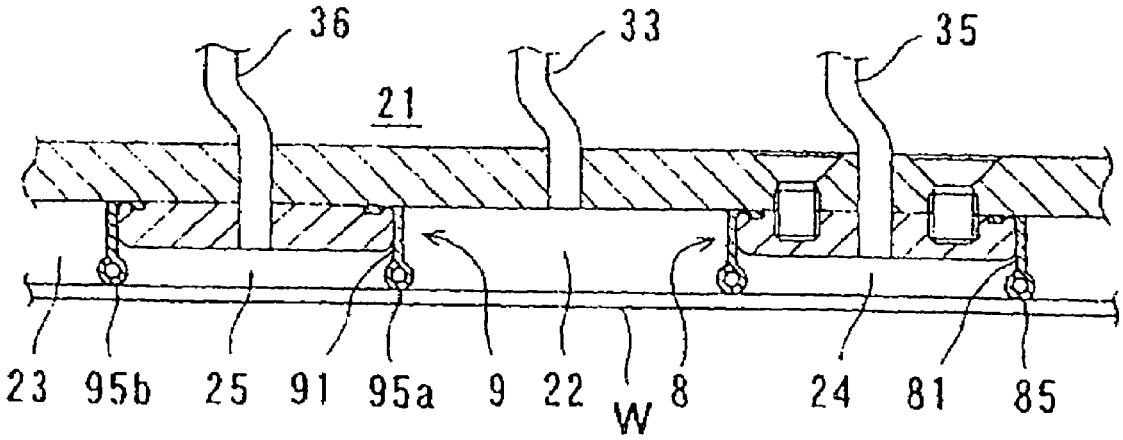
FIG. 11 is a vertical cross-sectional view showing another example of contact members (central bag and ring tube) in a substrate holding apparatus according to the present invention.

As shown in FIG. 11, an annular contacting portion 85 having a sealed fluid therein may be provided at a lower end of elastic membrane 81 of the central bag 8. Further, an (inner) annular contacting portion 95*a* and an (outer) annular contacting portion 95*b*, each having a sealed fluid therein, may be provided at a lower end of elastic membrane 91 of the ring tube 9. In this case, contacting portions 85, 95*a*, 95*b* are pressed against a semiconductor wafer W by a pressurized fluid supplied to pressure chamber 21 and, hence, pressure chambers 22, 23, central pressure chamber 24, and intermediate pressure chamber 25 are respectively sealed with the contacting portions 85, 95*a*, 95*b*. At this time, the contacting portions 85, 95*a*, 95*b* pressed against the semiconductor wafer W are deformed to increase an area in which the contacting portions 85, 95*a*, 95*b* are brought into contact with the semiconductor wafer W, so that a force applied to the semiconductor wafer W becomes larger. However, adjustment of pressure in the pressure chamber 21 can prevent an excessive force from being applied to the semiconductor wafer W by the contacting portions 85, 95*a* and 95*b*. The examples shown in FIGS. 8 through 11 can be applied to the first embodiment.

Figure 12:
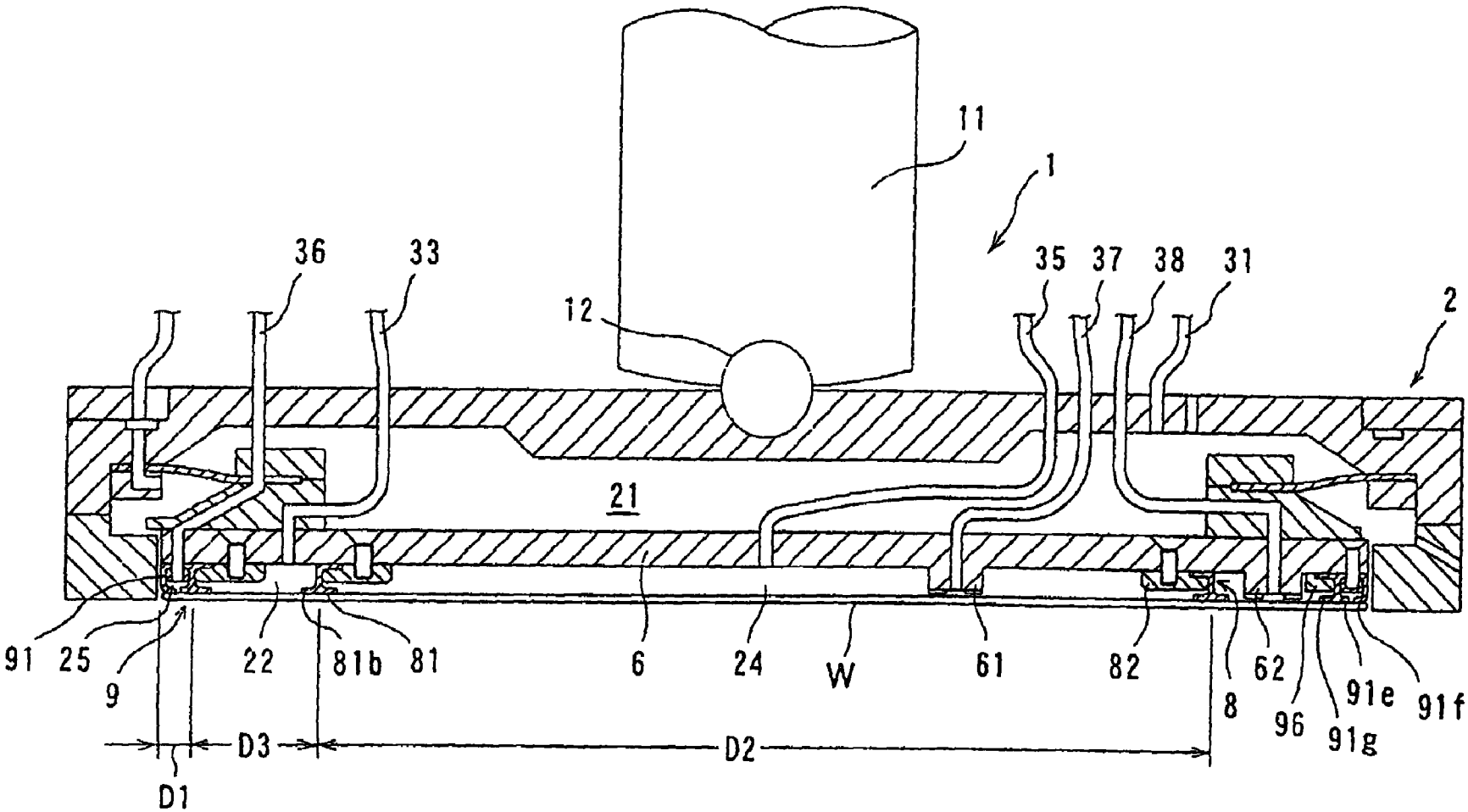
FIG. 12 is a vertical cross-sectional view showing a substrate holding apparatus according to a third embodiment of the present invention.
Figure 13:
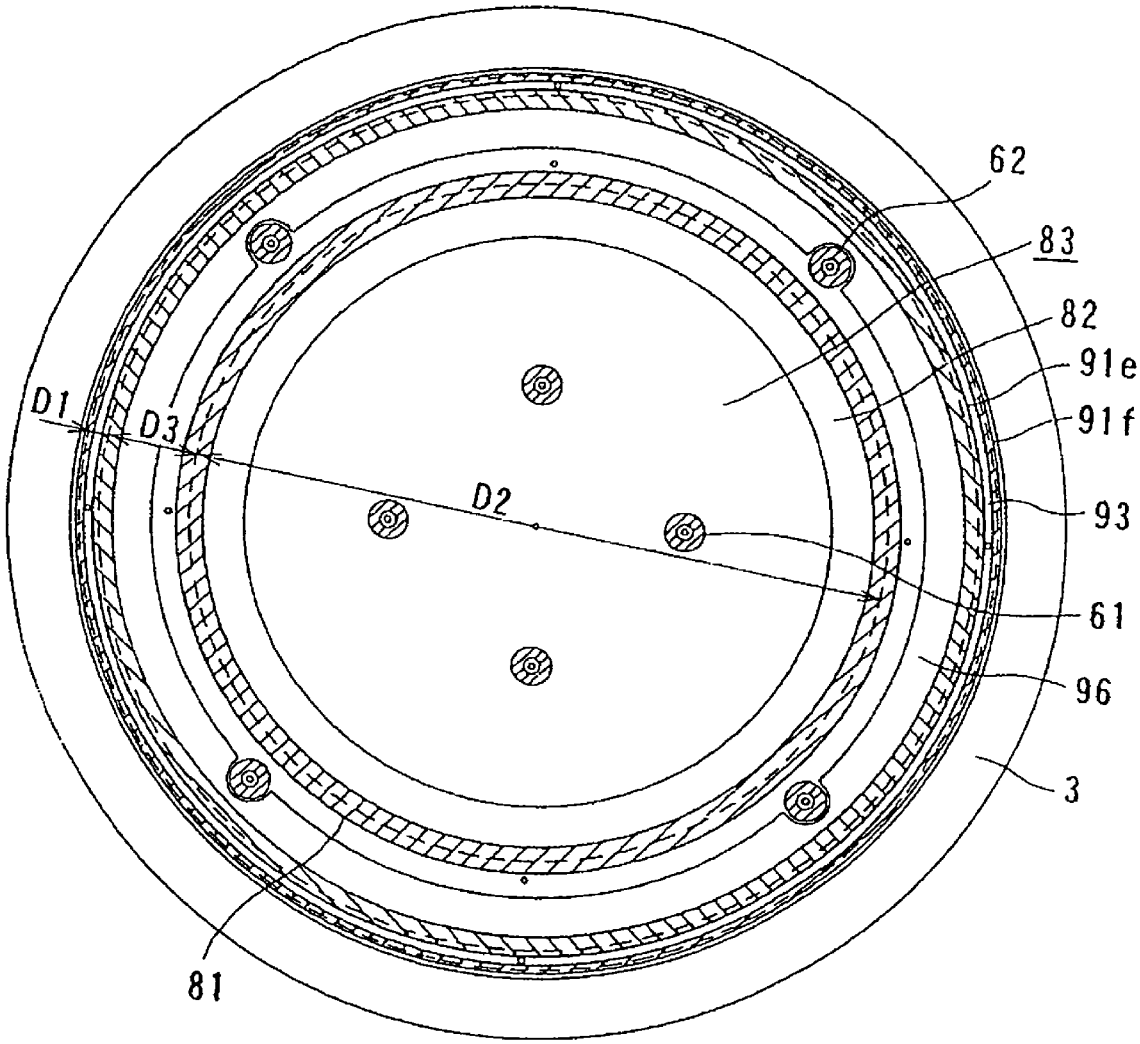
FIG. 13 is a bottom view of the substrate holding apparatus shown in FIG. 12.

A polishing apparatus according to a third embodiment of the present invention will be described below with reference to FIGS. 12 and 13. FIG. 12 is a vertical cross-sectional view showing a top ring 1 according to the third embodiment, and FIG. 13 is a bottom view showing the top ring 1 of FIG. 12 in such a state that a semiconductor wafer W is removed. Like parts and components are designated by the same reference numerals and characters as those in the second embodiment.

In the third embodiment, as shown in FIG. 12, the top ring 1 has no elastic pad and no seal ring. A central bag 8 has an annular central bag holder 82, and an annular elastic membrane 81 is held at an outer circumferential edge of the central bag holder 82. A circular hole 83 is formed in a lower surface of the elastic membrane 81 of the central bag 8, as with the example shown in FIGS. 8 and 9.

Ring tube 9 is mounted at a position corresponding to an outer peripheral portion of the semiconductor wafer W. The ring tube 9 has an inner elastic membrane 91*e* and an outer elastic membrane 91*f*, and an annular groove 93 is formed between the inner elastic membrane 91*e* and the outer elastic membrane 91*f*, as with the example shown in FIGS. 8 and 9. An annular auxiliary holder 96 is disposed inside of a ring tube holder. The inner elastic membrane 91*e* of the ring tube 9 has a protrusion extending radially inwardly from an upper end thereof. The protrusion is held by the auxiliary holder 96, so that the inner elastic membrane 91*e* is held securely.

The elastic membrane 81 of the central bag 8 has a protrusion 81*b* extending radially outwardly from a lower circumferential edge thereof. The inner elastic membrane 91*e* of the ring tube 9 has a protrusion 91*g* extending radially inwardly from a lower circumferential edge thereof. As described in the example shown in FIG. 5, these protrusions can widen a range of pressure control, for thereby pressing the semiconductor wafer W against a polishing surface more stably.

Chucking plate 6 has inner suction portions 61 and outer suction portions 62 for attracting a semiconductor wafer W thereto, as with the first embodiment. The inner suction portions 61 are disposed inside of the central bag 8, and the outer suction portions 62 are disposed between the central bag 8 and the ring tube 9.

In the present embodiment, the semiconductor wafer W is held by the top ring 1 such that the semiconductor wafer W is brought into contact with the elastic membranes 81, 91*e*, 91*f* of the central bag 8 and the ring tube 9. Therefore, the central bag 8 and the ring tube 9 jointly define a pressure chamber 22 between the semiconductor wafer W and the chucking plate 6. As described above, the ring tube 9 is mounted at a position corresponding to the outer peripheral portion of the semiconductor wafer W, and a pressure chamber (indicated by the reference numeral 23 in FIG. 7) is not defined outside of the ring tube 9.

Fluid passages 31, 33, 35, and 36 comprising tubes and connectors communicate with a pressure chamber 21 defined above the chucking plate 6, the pressure chamber 22, a central pressure chamber (first pressure chamber) 24 defined in the central bag 8, and an intermediate pressure chamber (first pressure chamber) 25 defined in the ring tube 9, respectively. The pressure chambers 21, 22, 24, and 25 are connected to a compressed air source via respective regulators connected respectively to the fluid passages 31, 33, 35 and 36. The regulators connected to the fluid passages 31, 33, 35 and, 36 of the pressure chambers 21, 22, 24, and 25 can respectively regulate pressures of pressurized fluids supplied to the pressure chambers 21, 22, 24, and 25, for thereby independently controlling pressures in the pressure chambers 21, 22, 24, and 25, or independently introducing atmospheric air or vacuum into the pressure chambers 21, 22, 24, and 25. Thus, pressures in the pressure chambers 21, 22, 24, and 25 are independently varied with the regulators, so that pressing forces can be adjusted in local areas of the semiconductor wafer W.

When the semiconductor wafer W is polished, it is difficult to uniformly polish a peripheral portion of the semiconductor wafer W because of elastic deformation of a polishing pad or the like or entry of a polishing liquid into a space between a polishing surface and the semiconductor wafer W, regardless of a thickness distribution of a thin film formed on a surface of the semiconductor wafer W to be polished. In the present embodiment, the ring tube 9 is mounted at a position corresponding to the outer peripheral portion of the semiconductor wafer W. Further, width D1 of the ring tube 9 is narrow, and diameter D2 of the central bag 8 is large. Hence, a pressing force applied to the peripheral portion of the semiconductor wafer W is controlled to uniformly polish the peripheral portion of the semiconductor wafer W. Specifically, the ring tube 9 should preferably have a width of at most 10 mm, more preferably at most 5 mm. Distance D3 between the central bag 8 and the ring tube 9 should preferably be in the range of 20 to 25 mm in a case of a semiconductor wafer having a diameter of 200 mm, and in the range of 25 to 30 mm in a case of a semiconductor wafer having a diameter of 300 mm.

While the present invention has been described in detail with reference to the preferred embodiments thereof, it would be apparent to those skilled in the art that many modifications and variations may be made therein without departing from the spirit and scope of the present invention.

In the embodiments described above, the fluid passages 31, 33, 34, 35. and 36 are provided as separate passages. However, an arrangement of fluid passages and pressure chambers may be modified in accordance with a magnitude of a pressing force to be applied to a semiconductor wafer W and a position to which the pressing force is applied. For example, these passages may be joined to each other, or the pressure chambers may be connected to each other.

The pressure chambers 22, 23 may be connected to the pressure chamber 21 to form one pressure chamber, without the fluid passage 33 communicating with the pressure chamber 22 and the fluid passage 34 communicating with the pressure chamber 23. In this case, pressures in pressure chambers 21, 22, 23, are controlled at an equal pressure by a pressurized fluid supplied via the fluid passage 31. If it is not necessary to provide a pressure difference between the pressure chamber 22 and the pressure chamber 23, and pressures in central pressure chamber 24 and intermediate pressure chamber 25 are not larger than pressures in the pressure chambers 21, 22, 23, then the above arrangement can be adopted to dispense with fluid passages 33, 34, for thereby decreasing the number of fluid passages and simplifying the fluid passages.

When the inner suction portions 61 and the outer suction portions 62 are provided on the chucking plate 6, as in the first and third embodiments, not only is a vacuum created in the fluid passages 37, 38 communicating with the suction portions 61, 62, but also pressurized fluids may be supplied to the fluid passages 37, 38. In this case, suction of a semiconductor wafer at the suction portions 61, 62 and supply of pressurized fluids to the pressure chambers 22, 23 can be performed with one respective passage. Hence, it is not necessary to provide two fluid passages, i.e., the fluid passages 33, 34, for thereby decreasing the number of fluid passages and simplifying the fluid passages.

Figure 14:
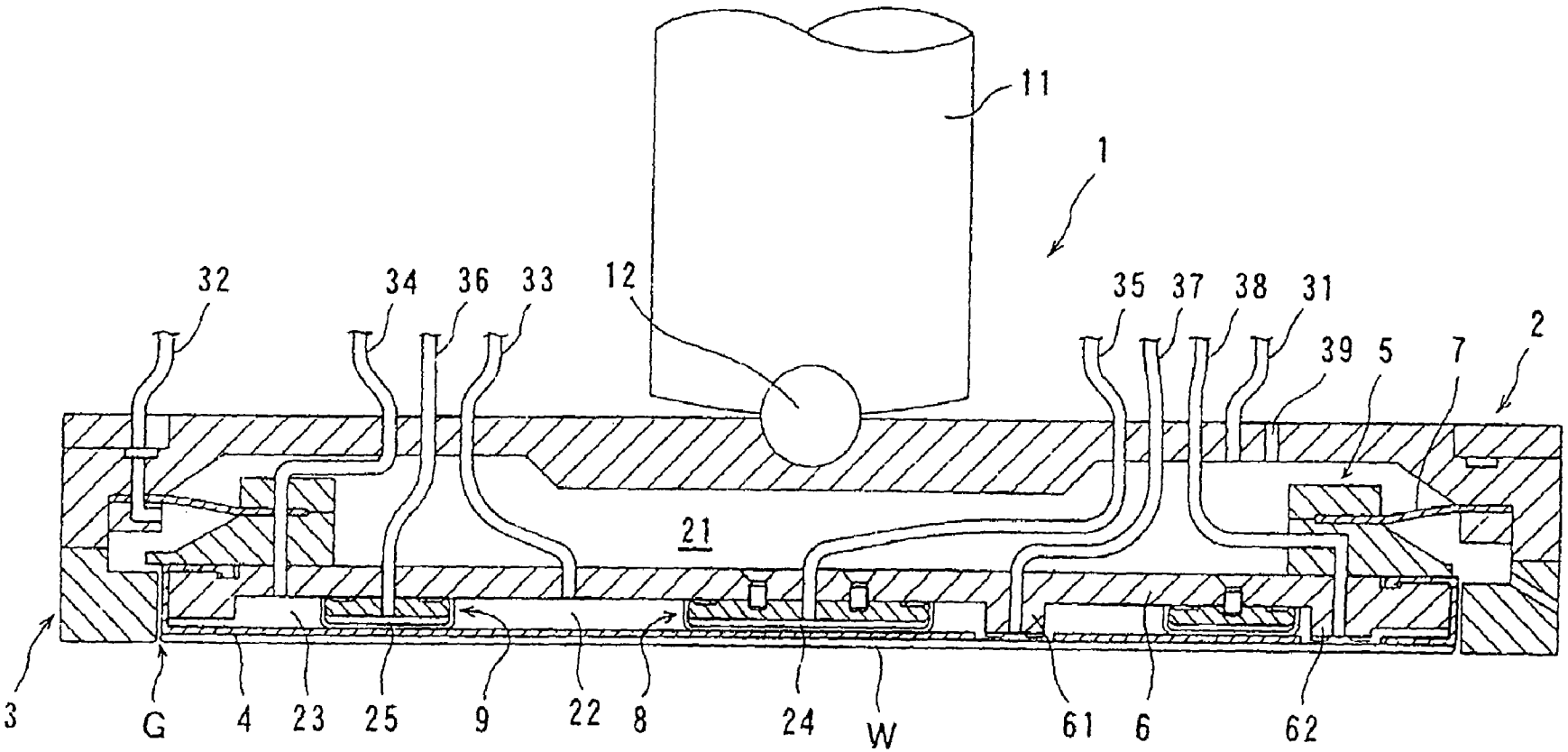
FIG. 14 is a vertical cross-sectional view showing a substrate holding apparatus according to another embodiment of the present invention.

In the first and second embodiments, the chucking plate 6 has a protuberance 63 projecting downwardly from the outer circumferential edge thereof for maintaining a shape of a lower peripheral portion of the elastic pad 4 or the seal ring 42 (see FIGS. 2 and 7). However, if it is not necessary to maintain the shape of the elastic pad 4 or the seal ring 42 because of its material or the like, then the chucking plate 6 does not need to have such a protuberance. FIG. 14 is a vertical cross-sectional view showing a top ring 1 in which the chucking plate 6 has no protuberance 63 as in the first embodiment. In this case, semiconductor wafer W can be uniformly pressed from a central portion thereof to an outer peripheral portion thereof. Further, the semiconductor wafer can easily follow a large waviness or undulation on a polishing surface.

In the embodiments described above, the polishing surface is a polishing pad. However, the polishing surface is not limited to this. For example, the polishing surface may be a fixed abrasive. The fixed abrasive is formed into a flat plate comprising abrasive particles fixed by a binder. With the fixed abrasive, a polishing process is performed by the abrasive particles self-generated from the fixed abrasive. The fixed abrasive comprises abrasive particles, a binder, and pores. For example, cerium dioxide ($CeO_2$) having an average particle diameter of 0.5 μm is used as an abrasive particle, and epoxy resin is used as a binder. Such a fixed abrasive forms a harder polishing surface. The fixed abrasive includes a fixed abrasive pad having a two-layer structure formed by a thin layer of a fixed abrasive and an elastic polishing pad attached to the layer of the fixed abrasive. IC-1000 described above may be used for another hard polishing surface.

As described above, according to the present invention, pressures in a first pressure chamber and a second pressure chamber can be independently controlled. Therefore, a pressing force applied to a thicker area of a thin film can be made higher than a pressing force applied to a thinner area of the thin film, thereby selectively increasing a polishing rate of the thicker area of the thin film. Consequently, an entire surface of a substrate can be polished exactly to a desired level irrespective of film thickness distribution obtained at a time the thin film is formed.

Further, according to the present invention, a contact member comprises a holding member for detachably holding an elastic membrane, or the holding member of the contact member is detachably mounted on a support member. Hence, the elastic membrane or the contact member can easily be replaced. Specifically, a position and size of a first pressure chamber and second pressure chamber can be changed simply by changing the elastic membrane or the contact member. Therefore, a substrate holding apparatus according to the present invention can easily cope with various thickness distributions of a thin film formed on a substrate to be polished at a low cost.

In a substrate holding apparatus comprising a seal ring, a lower surface of a support member is not covered after a semiconductor wafer is released. Therefore, a large part of the lower surface of the support member is exposed after the semiconductor wafer is released, so that the substrate holding apparatus can easily be cleaned after a polishing process.

Furthermore, a protrusion radially extending from a circumferential edge of the elastic membrane of each contact member is provided on a lower surface of the elastic membrane. Therefore, the protrusion is brought into close contact with an elastic pad or a substrate by a pressurized fluid supplied to the second pressure chamber to prevent the pressurized fluid from flowing into a lower portion of the contact member. Hence, a range of pressure control can be widened to press a substrate against a polishing surface more stably.

Although certain preferred embodiments of the present invention have been shown and described in detail, it should be understood that various changes and modifications may be made therein without departing from the scope of the appended claims.

The invention claimed is:

1. A substrate holding apparatus for holding a substrate and applying a pressing force to press the substrate against a polishing surface, said substrate holding apparatus comprising:

a top ring body for holding the substrate, said top ring body being made of a non-magnetic material;

an elastic pad to be brought into contact with the substrate, said elastic pad being made of a rubber material; and a contact member including (i) an elastic member to be brought into contact with said elastic pad, said elastic member including a protrusion that is brought into contact with said elastic pad and extends radially from a circumferential edge at a lower surface of said elastic member along said elastic pad; and (ii) a holding member for detachably holding said elastic member, said holding member being made of a non-magnetic material.

2. The substrate holding apparatus as recited in claim 1, wherein said substrate holding apparatus is disposed in a polishing apparatus that is for measuring a thickness of a film on the substrate by using eddy current.

3. The substrate holding apparatus as recited in claim 1, wherein said top ring body and said holding member are made of ceramic.

4. The substrate holding apparatus as recited in claim 1, wherein said protrusion is sized and configured to enable a range of pressure control in each of at least two pressure chambers to be more flexible.

5. The substrate holding apparatus as recited in claim 1, wherein said protrusion is sized and configured to prevent high-pressure fluid in one pressure chamber from flowing into an adjacent pressure chamber having low-pressure fluid therein.

* * * * *